US011223154B2

(12) United States Patent
Jabrane et al.

(10) Patent No.: US 11,223,154 B2
(45) **Date of Patent: *Jan. 11, 2022**

(54) MSL CONNECTOR SERIES

(71) Applicant: J.S.T. CORPORATION, Farmington Hills, MI (US)

(72) Inventors: Khalid Jabrane, Novi, MI (US); Franklin A. Holub, West Bloomfield, MI (US); Rajit Abraham, Shelby Township, MI (US)

(73) Assignee: J.S.T. CORPORATION, Farmington Hills, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/885,630

(22) Filed: May 28, 2020

(65) Prior Publication Data

US 2020/0295495 A1 Sep. 17, 2020

Related U.S. Application Data

(62) Division of application No. 16/724,170, filed on Dec. 20, 2019, now Pat. No. 10,886,657, which is a (Continued)

(51) Int. Cl.
*H01R 13/627* (2006.01)
*H01R 13/436* (2006.01)
*H01R 13/639* (2006.01)

(52) U.S. Cl.
CPC ..... *H01R 13/4367* (2013.01); *H01R 13/4362* (2013.01); *H01R 13/6272* (2013.01); *H01R 13/639* (2013.01)

(58) Field of Classification Search
CPC .. H01R 13/6275; H01R 9/03; H01R 13/6272; H01R 13/641; H01R 13/7175;
(Continued)

(56) References Cited

U.S. PATENT DOCUMENTS 4,565,416 A 1/1986 Rudy
4,946,398 A 8/1990 Takenouchi
(Continued)

FOREIGN PATENT DOCUMENTS

EP 0828318 A2 3/1998
EP 3046185 A 7/2016
(Continued)

OTHER PUBLICATIONS

U.S. PTO Office Action in U.S. Appl. No. 15/405,654, dated Jun. 29, 2017.
(Continued)

*Primary Examiner* — Thanh Tam T Le
(74) *Attorney, Agent, or Firm* — Kratz, Quintos & Hanson, LLP

(57) ABSTRACT

Connector apparatus having a female connector assembly and a male connector assembly. The female connector assembly includes a female housing, a connector position assurance (CPA) member for assuring the engagement of the male connector assembly with the female connector assembly, and a first terminal position assurance (TPA) member for assuring that terminals for the female connector assembly are positioned properly. The female housing further includes a connector latch used to securely hold together a connector apparatus. The female housing has TPA protection ribs and CPA protection walls. The male housing has TPA protection ribs.

3 Claims, 37 Drawing Sheets

Related U.S. Application Data division of application No. 15/407,562, filed on Jan. 17, 2017, now Pat. No. 10,673,168.

(60) Provisional application No. 62/278,552, filed on Jan. 14, 2016.

(58) Field of Classification Search
CPC ..... H01R 13/4223; H01R 13/4362; H01R 13/4367; H01R 13/639
USPC ..... 439/345, 350–352, 489, 490, 595, 752
See application file for complete search history.

(56) References Cited

U.S. PATENT DOCUMENTS

| | | | | |
|---|---|---|---|---|
| 5,004,436 | A | 4/1991 | Aoyama | |
| 5,145,419 | A | 9/1992 | Yamanashi | |
| 5,224,883 | A | 7/1993 | Yamamoto | |
| 5,252,096 | A * | 10/1993 | Okada | H01R 13/4362 439/752 |
| 5,358,427 | A * | 10/1994 | Miwa | H01R 13/4362 439/595 |
| 5,370,543 | A | 12/1994 | Hamada | |
| 5,474,477 | A * | 12/1995 | Aoyama | H01R 13/4362 439/752 |
| 5,507,666 | A | 4/1996 | Yamanashi | |
| 5,516,308 | A | 5/1996 | Yamanashi | |
| 5,597,325 | A | 1/1997 | Maejima | |
| 5,782,657 | A | 7/1998 | Wolla | |
| 5,830,013 | A | 11/1998 | Saito | |
| 5,839,915 | A | 11/1998 | Ford | |
| 5,928,038 | A | 7/1999 | Berg | |
| 5,934,946 | A * | 8/1999 | Nakamura | H01R 13/4362 439/752 |
| 6,010,374 | A | 1/2000 | Miwa | |
| 6,036,552 | A | 3/2000 | Atsumi | |
| 6,068,507 | A | 5/2000 | Popa | |
| 6,135,802 | A | 10/2000 | Nakamura | |
| 6,171,150 | B1 | 1/2001 | Saito | |
| 6,261,116 | B1 | 7/2001 | Ceru | |
| 6,296,531 | B1 | 10/2001 | Nagamine | |
| 6,390,859 | B2 * | 5/2002 | Furutani | H01R 13/4362 439/752 |
| 6,464,544 | B1 | 10/2002 | Yamamoto | |
| 6,527,583 | B2 | 3/2003 | Plate | |
| 6,648,699 | B1 | 11/2003 | Makino | |
| 6,655,999 | B2 | 12/2003 | Mase | |
| 6,702,626 | B2 | 3/2004 | Ichio | |
| 6,780,045 | B2 | 8/2004 | Shuey | |
| 6,780,069 | B2 | 8/2004 | Scherer | |
| 6,902,443 | B2 * | 6/2005 | Hara | H01R 13/4362 439/752 |
| 7,114,992 | B2 | 10/2006 | Sagawa | |
| 7,182,652 | B2 | 2/2007 | Yamakada | |
| 7,195,522 | B2 | 3/2007 | Okada | |
| 7,261,603 | B2 | 8/2007 | Takahashi | |
| 7,278,890 | B1 | 10/2007 | Smutny | |
| 7,347,745 | B1 | 3/2008 | Raudenbush | |
| 7,445,524 | B2 * | 11/2008 | Horiuchi | H01R 13/4361 439/752 |
| 7,500,887 | B2 | 3/2009 | Ichio | |
| 7,544,081 | B2 | 6/2009 | Lim | |
| 7,556,539 | B2 | 7/2009 | Takahashi | |
| 7,563,134 | B2 | 7/2009 | Kim | |
| 7,811,126 | B1 | 10/2010 | Chen | |
| 8,075,351 | B2 | 12/2011 | Park | |
| 8,096,841 | B2 | 1/2012 | Hirano | |
| 8,277,243 | B1 * | 10/2012 | Hernandez | H01R 13/641 439/352 |
| 8,641,458 | B2 | 2/2014 | Matsumura | |
| 8,727,816 | B2 * | 5/2014 | Takahashi | H01R 13/4361 439/752 |
| 8,747,146 | B2 | 6/2014 | Brown | |
| 8,951,066 | B2 | 2/2015 | Glick | |
| 9,017,108 | B2 | 4/2015 | Suemitsu | |
| 9,039,462 | B2 | 5/2015 | Yoon | |
| 9,048,563 | B2 | 6/2015 | Miura | |
| 9,160,095 | B2 | 10/2015 | Littek | |
| 9,318,847 | B2 | 4/2016 | Endo | |
| 9,997,867 | B2 * | 6/2018 | Moriyasu | H01R 24/20 |
| 2017/0179643 | A1 | 6/2017 | Holub | |
| 2017/0207577 | A1 | 7/2017 | Holub | |
| 2017/0207578 | A1 | 7/2017 | Abraham | |
| 2017/0207594 | A1 | 7/2017 | Jabrane | |
| 2020/0127408 | A1 * | 4/2020 | Jabrane | H01R 13/4362 |

FOREIGN PATENT DOCUMENTS

| | | | |
|---|---|---|---|
| GB | 2255864 | A | 11/1992 |
| JP | 2015-032506 | A | 2/2015 |

OTHER PUBLICATIONS

U.S. PTO Office Action in U.S. Appl. No. 15/405,654, dated Jan. 25, 2018.
European Search Report in European Application Serial No. 17207724.0, dated Mar. 29, 2018.
European Search Report in European Application Serial No. 17207725.7, dated Mar. 29, 2018.
European Search Report in European Application Serial No. 17207739.8, dated Mar. 29, 2018.
European Search Report in European Application Serial No. 17207747.1, dated Mar. 29, 2018.
U.S. PTO Office Action in U.S. Appl. No. 15/405,405, dated Jan. 8, 2018.
U.S. PTO Office Action in U.S. Appl. No. 15/405,405, dated Jul. 26, 2017.
U.S. PTO Office Action in U.S. Appl. No. 15/405,405, dated May 16, 2017.
Office Action of Japanese Patent Application No. 2017-237654: Notification of Reason for Refusal dated Jan. 29, 2019 (5 pages, 5 pages translation, 10 pages total).
Office Action of Japanese Patent Application No. 2017-237656: Notification of Reason for Refusal dated Jan. 29, 2019 (5 pages, 5 pages translation, 10 pages total).

* cited by examiner

MSL CONNECTOR SERIES

CROSS-REFERENCE TO RELATED APPLICATIONS

This patent application claims priority to U.S. Provisional Patent Application No. 62/278,552, filed Jan. 14, 2016, which is hereby incorporated herein by reference in its entirety.

BACKGROUND OF THE INVENTION

The present invention generally relates to a connector apparatus having a female connector assembly and a male connector assembly.

BRIEF SUMMARY OF THE INVENTION

The present invention generally relates to a connector apparatus having a female connector assembly and a male connector assembly.

The female connector assembly includes a female housing, a connector position assurance (CPA) member for assuring the engagement of the male connector assembly with the female connector assembly, and a first terminal position assurance (TPA) member for assuring that terminals for the female connector assembly are positioned properly. The female housing further includes a connector latch used to securely hold together a connector apparatus.

The male connector assembly includes a male housing and a second TPA member for assuring that terminals for the male connector assembly are positioned properly.

The female connector assembly and male connector assembly can be mated together.

The connector apparatus, having the female housing, male housing, CPA member, first TPA member, second TPA member, and connector latch, provides a number of desirable characteristics, including at least, for example: an audible "click" sound when the female connector assembly and the male connector assembly are mated together, which is an extra loud sound; a low profile connector latch; a resistance to permanent set for the connector latch; a resistance to movement to final lock position for the CPA member, first TPA member, and second TPA member; a moderate amount of reinforcement; mutual retention; good mechanical strength; easy molding features; no secondary operation of a user is required; failure prevention means; and good dimensional control of latching geometry.

To ensure that the first TPA member is made available for connecting to the female housing during transport thereof, for example, the first TPA is engaged, in a preset position, to the female housing.

To ensure that the second TPA member is made available for connecting to the male housing during transport thereof, for example, the second TPA is engaged, in a preset position, to the male housing.

To ensure that the CPA member is made available for connecting to the female housing during transport thereof, for example, the CPA member is engaged, in a preset position, to the female housing.

At least one terminal can be provided into each of the male connector assembly and the female connector assembly, when the first TPA member and the second TPA member are in the preset position.

The male connector assembly and female connector assembly are engaged together, and the engagement thereof is assured when the CPA member is placed in a final lock position.

The set of terminals provided for the female connector assembly is secured thereto when the first TPA member is placed in the final lock position.

The set of terminals provided for the male connector assembly is secured thereto when the second TPA member is placed in the final lock position.

It is a desirable trait to have an audible "click" sound for a connector. For example, when components of an automotive connector are completely mated with each other, it is a desirable trait to have an audible "click" sound for convenient assurance that the components are completely mated. In the automotive connector field, an extra loud sound is favorable. It is desirable to have the loudest "click" sound possible. The "click" sound can be achieved by an interaction of latching features, for example. By placing latching features in a preloaded condition, there is additional force when a first connector assembly and a second connector assembly are mated together, and that additional force helps to make the "click" sound louder than it would have been if the latching features had not been in a preloaded condition.

It is a desirable trait for the connector latch to have a low profile. By manufacturing the connector latch in an undeflected position, the gaps required to create overstress protection features, to prevent the connector latch from being pried in the wrong direction and damaged, are not needed. The gaps can be removed from the overall height of the latch system, so that the connector latch can have a low profile.

It is a desirable trait to have a resistance to being set. For example, when automotive wire harnesses are bundled for shipment, the connector latches can be unintentionally compressed and held in a deflected position. Especially in hot environments, this condition causes the connector latch to be permanently deflected, also known as permanently set, thus rendering the connector latch useless or less effective. Preloading the connector latch makes the connector latch more resistant to this failure mode.

It is a desirable trait to have good dimensional control of latching geometry. By preloading the connector latch against dimensionally stable features, the height of the connector latch features can be controlled easily.

After the connector latch is manufactured, the connector latch is in an undeflected position. The connector latch is then subjected to a pre-mating deflection process, in order to deflect the connector latch and lock the connector latch in a preloaded position. After the pre-mating deflection process has been completed, the connector latch is locked in a preloaded position and can be referred to as a preloaded connector latch.

When a first connector assembly and a second connector assembly are engaged together, the engagement thereof is assured because the connector latch causes an audible "click" sound. A first connector assembly can correspond to a female connector assembly or other type of connector assembly, for example. A second connector assembly can correspond to a male connector assembly or other type of connector assembly, for example. The undeflected position can also be referred to as an extended and relaxed undeflected position.

Each TPA member has at least one flexible feature and at least one guide. The flexible feature can also be referred to as a protrusion. The guide can provide proper guidance and avoid any imbalance created during engagement of a TPA member with a housing.

A CPA member provides a number of desirable characteristics, including at least, for example: it helps to achieve a full potential force of the system and desirable audible "click" sound when the CPA member is inserted into a housing; it helps to avoid a CPA member being moved to a final lock position (or "set" position) during shipping and/or handling; it requires no secondary operation of a user; and it helps prevent failure.

A TPA member provides a number of desirable characteristics, including at least, for example: it helps to achieve a full potential force of the system and desirable audible "click" sound when the TPA member is inserted into a housing; it helps to avoid a TPA member being moved to a final lock position during shipping and/or handling; it requires no secondary operation of a user; and it helps prevent failure.

Because of the use of a TPA member having the guide, the TPA member's first pair of flexible features is more likely to engage substantially simultaneously, and then subsequently the TPA member's second pair of flexible features is more likely to engage substantially simultaneously, thereby achieving full potential force of the system and producing an audible "click" sound. Because of the guide, there is additional force when a TPA member and a connector assembly are mated together, and that additional force helps to make the "click" sound louder than it would have been if the guide was not present.

It is a desirable trait to avoid a TPA member being moved to a final lock position during shipping and/or handling. The guide and flexible features of the TPA member help to make the TPA member more resistant to entering a final lock position during shipping and/or handling. The guide and flexible features of the TPA members help to prevent a movement of the TPA members from a preset position to a final lock position during shipping and/or handling.

It is a desirable trait for a TPA member to avoid a need for a secondary operation of a user. The guide and flexible features of TPA members help to avoid a need for a secondary operation of a user. The desired movement can be accomplished by a single operation of a user.

It is a desirable trait for a TPA member to help prevent failure. The location/guide features and flexible features of TPA members, according to the principles disclosed herein, help to avoid failure.

When a TPA member and a housing are engaged together in a final lock position, the engagement thereof is assured because there is an audible "click" sound.

The connector apparatus of the present invention is at least one part of MSL connector series.

Additional features, advantages, and embodiments of the invention are set forth or apparent from consideration of the following detailed description, drawings and claims. Moreover, it is to be understood that both the foregoing summary of the invention and the following detailed description are exemplary and intended to provide further explanations without limiting the scope of the invention as claimed.

DETAILED DESCRIPTION OF THE PREFERRED EMBODIMENTS

Figure 1:
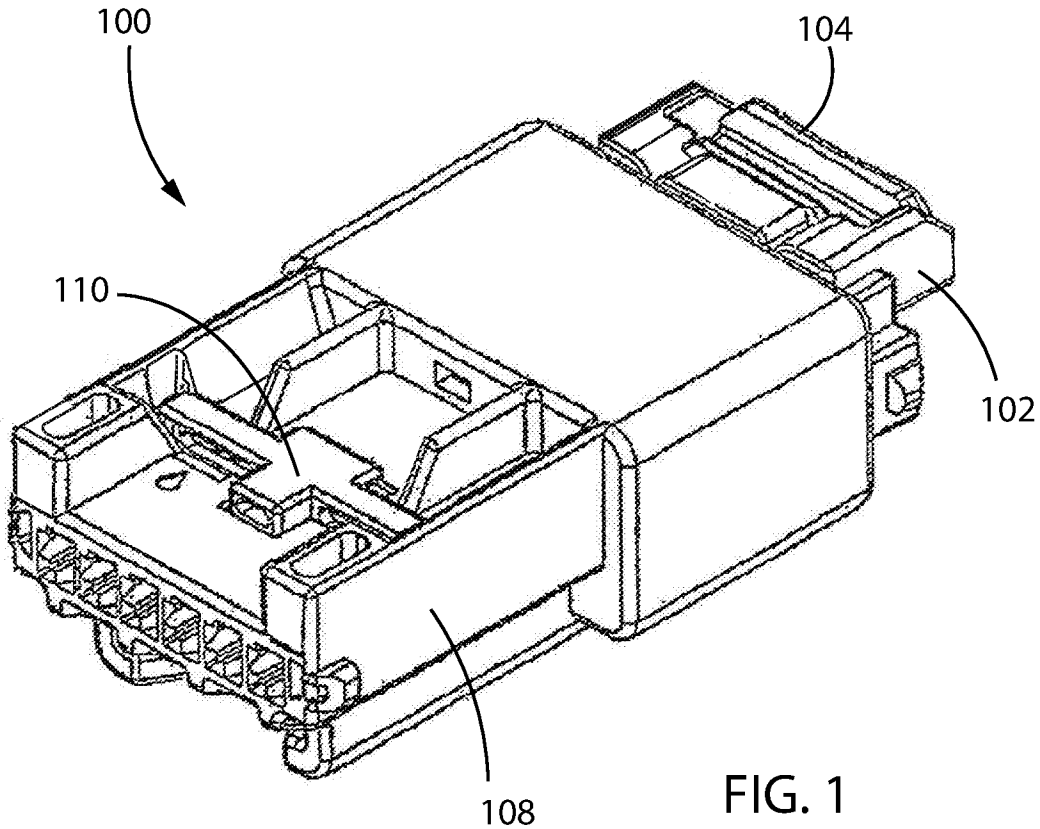
FIG. 1 is a perspective view of a connector apparatus, in accordance with the principles of the present invention, in a six-pin configuration.

FIG. 1 is a perspective view of a connector apparatus, in accordance with the principles of the present invention, in a six-pin configuration. FIG. 1 illustrates a connector apparatus, generally referred to by reference numeral 100, which includes a female housing 102, a CPA member 104 in the female housing 102, a male housing 108, and a TPA member 110 in the male housing 108. As shown in FIG. 1, the female housing 102 is mated with the male housing 108.

Figure 2:
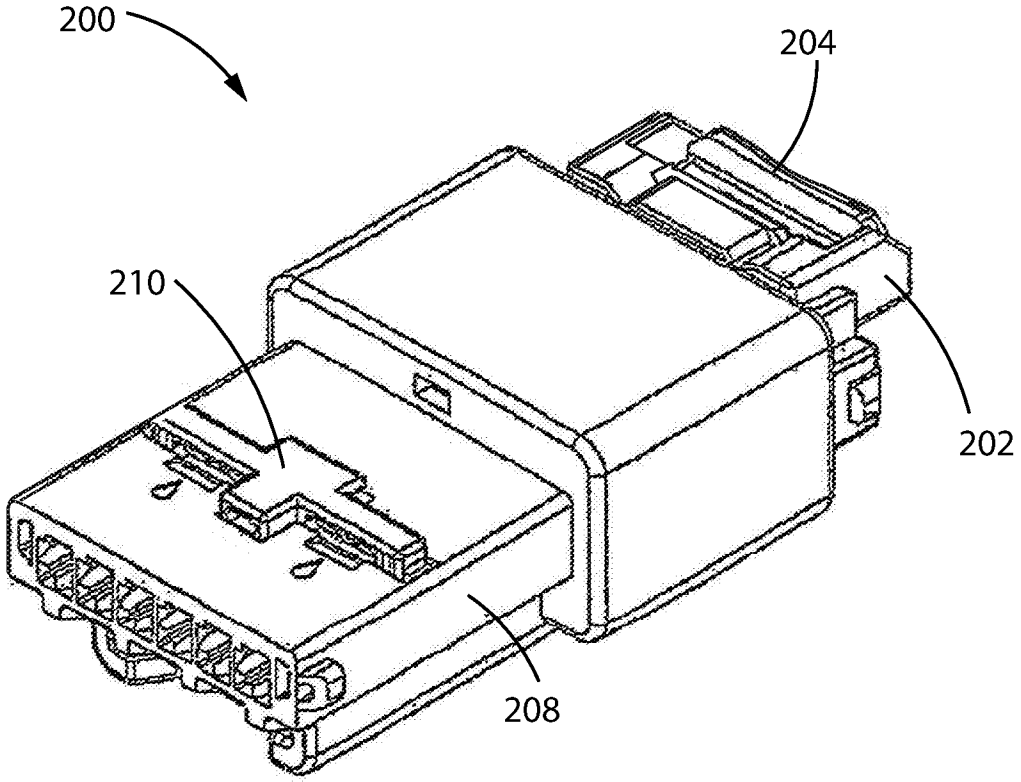
FIG. 2 is a perspective view of a connector apparatus, in accordance with the principles of the present invention, in a six-pin configuration.

FIG. 2 is a perspective view of a connector apparatus, in accordance with the principles of the present invention, in a six-pin configuration. FIG. 2 illustrates a connector apparatus, generally referred to by reference numeral 200, which includes a female housing 202, a CPA member 204 in the female housing 202, a male housing 208, and a TPA member 210 in the male housing 208. As shown in FIG. 2, the female housing 2102 is mated with the male housing 208.

A full connector assembly consists of a male connector assembly and a female connector assembly. The full connector assembly can also be referred to as a connector apparatus.

The female connector assembly consists of a female housing, a TPA member, and a CPA member. For female sub-assembly, the TPA member and CPA member are inserted into the female housing in the preset position.

The male connector assembly consists of a male housing and a TPA member. For male sub-assembly, the TPA member is inserted into the male housing in the preset position.

The female and male connector assemblies are assembled separately. After inserting terminals in both the female and male connector assemblies, the TPA member is pushed to the final lock position for providing a secondary locking to the terminals. Both sub-assemblies are then mated to make a system assembly.

The female housing has a connector latch which latches with the male housing to interlock. The CPA member provides an assurance that both female and male connector assemblies are locked. Then the CPA member is pushed to the final lock position.

The connector apparatus of the present invention includes a number of advantages and improvements. The connector apparatus of the present invention can help to prevent a locking latch from getting damaged/deformed during shipping and handling, and thus can help prevent mating problems.

The connector apparatus of the present invention can help to prevent a CPA member from getting damaged/deformed during shipping and handling, and thus can help prevent mating problems.

The connector apparatus of the present invention can help to prevent a TPA member from getting inadvertently pushed into the final lock position during shipping and handling, and thus can help prevent terminal insertion problems.

The connector apparatus of the present invention can help to prevent a user from needing to engage in secondary operations.

The connector apparatus of the present invention can help to prevent complaints from a user, because it helps prevent problems associated with an inadvertent movement of a TPA member or CPA member to a final lock position during shipping and/or handling, for example.

The connector apparatus of the present invention provides an improved connector assembly comprising a female housing and male housing designed to provide a superior audible click sound, moderate reinforcement, mutual retention, good mechanical strength when the female and male housings engage with each other, and extremely easy molding consideration by manufacturing the female housing's connector latch with overbuild and then pushing the button of the connector latch to a preset position during assembly.

After the connector latch of the present invention is manufactured, the connector latch is in the extended and relaxed undeflected position. When the connector latch is in that position, the button 902 of the connector latch is extended upward, above a top 410 of a female housing 400. The button 902 is held up in the extended and relaxed undeflected position by the latch beams 904 and 906.

As indicated above, after the connector latch of the present invention is manufactured, the connector latch is in the extended and relaxed undeflected position. The connector latch is then subjected to a pre-mating deflection process, in order to deflect the connector latch and lock the connector latch in a preloaded position.

After the pre-mating deflection process has been completed, the connector latch is locked in a preloaded position and can be referred to as a preloaded connector latch.

FIGS. 3, 4A, 5A, 7A, and 8A, for example, show a female housing 400 having a connector latch in accordance with the principles of the present invention, showing the connector latch in a preloaded position.

The connector apparatus of the present invention can help to provide protection to a TPA member by having TPA protection ribs 416, 418, 442, 444, 446, and 448 around the TPA member on the female housing 400, for example. Those ribs help to prevent the TPA member from contacting other connectors during shipping and handling, to help reduce the occurrence of set TPA members, for example. That is, the ribs help to prevent TPA members from inadvertently moving from the preset position to the final lock position during shipping and handling, for example.

The connector apparatus of the present invention can help to provide protection to a TPA member by having TPA protection ribs 740, 742, 744, 746, 748, and 750 around the TPA member on the male housing 700, for example. Those ribs help to prevent the TPA member from contacting other connectors during shipping and handling, to help reduce the occurrence of set TPA members, for example. That is, the ribs help to prevent TPA members from inadvertently moving from the preset position to the final lock position during shipping and handling, for example.

The connector apparatus of the present invention can help to provide protection to a CPA member by having CPA protection walls 432, 434, and 436 around the CPA member on the female housing 400, for example. Those walls help to prevent the CPA member from contacting other components and wiring harnesses during shipping and handling, and help to prevent damage, for example.

The connector apparatus of the present invention can help to protect foreign wires belonging to an adjacent harness from being caught in components by providing anti-snagging features to the female housing and male housing.

The connector apparatus of the present invention can help the TPA members and CPA members to stay in the preset position during shipping and handling.

The connector apparatus of the present invention can prevent a need for a user to engage in a secondary operation such as trying to move a TPA member from a final lock position to a preset position, for example, after the TPA member was inadvertently moved into the final lock position during shipping and handling.

The connector apparatus of the present invention can prevent a need for a user to engage in a secondary operation such as trying to move a CPA member from a final lock position to a preset position, for example, after the CPA member was inadvertently moved into the final lock position during shipping and handling.

The connector apparatus of the present invention can help prevent customer complaints, because it helps avoid snags with other cables.

The connector apparatus of the present invention can help prevent a need for tray packaging.

FIG. 1 depicts a male housing 108 with TPA protection ribs, and depicts a female housing 102 with CPA protection walls.

FIG. 2 depicts a male housing 208 without TPA protection ribs, and depicts a female housing 202 with CPA protection walls.

Figure 3:
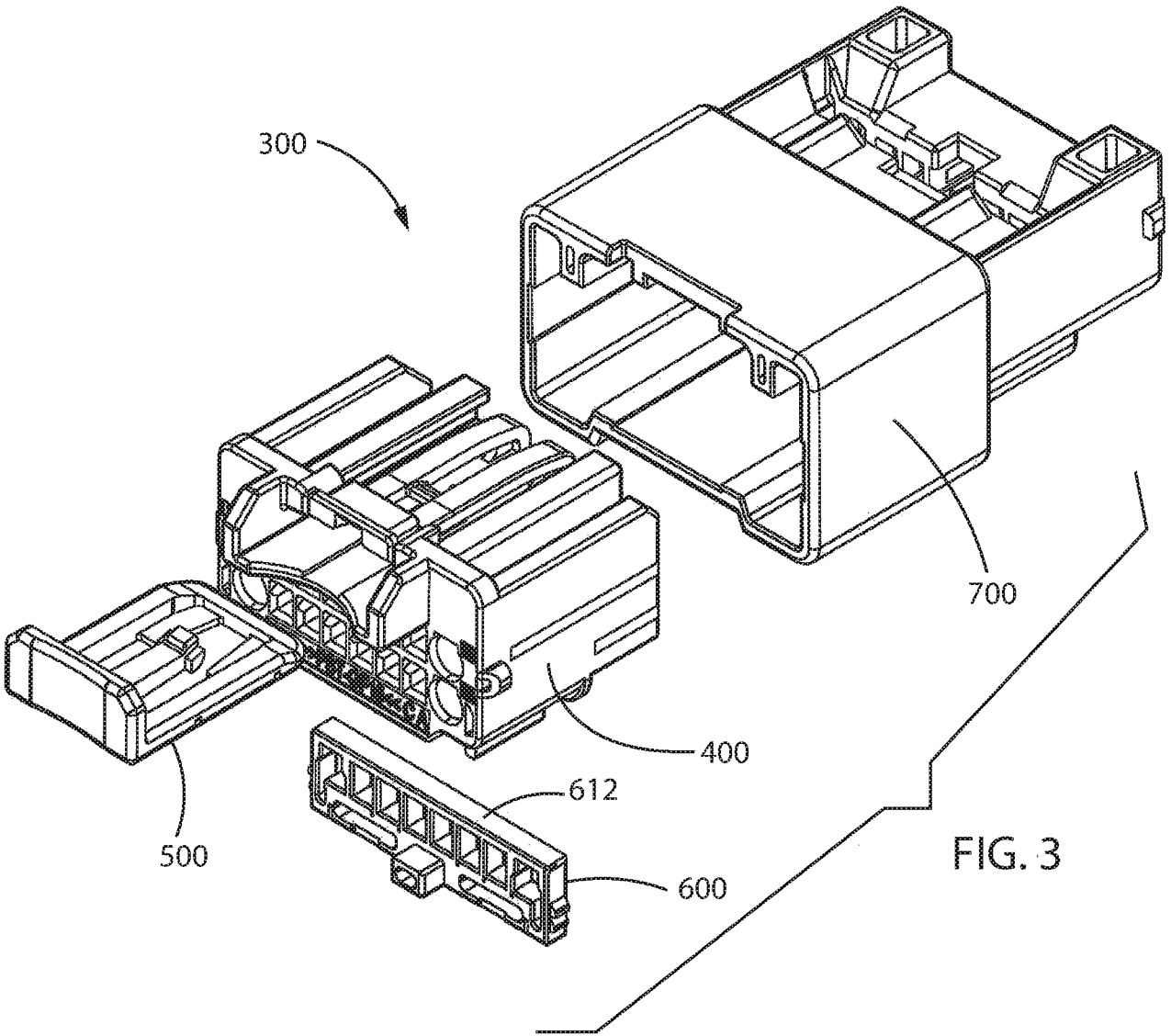
FIG. 3 is an exploded perspective view of parts of a connector apparatus, in accordance with the principles of the present invention, showing a female housing, a TPA member for the female housing, a CPA member for the female housing, and a male housing, in a sixteen-pin configuration.

FIG. 3 is an exploded perspective view of parts of a connector apparatus, in accordance with the principles of the present invention, showing a female housing, a TPA member for the female housing, a CPA member for the female housing, and a male housing, in a sixteen-pin configuration.

FIG. 3 illustrates a connector apparatus, generally referred to by reference numeral 300, which includes a female housing 400, a CPA member 500 for the female housing 400, a male housing 700, and a TPA member 600. An insertion side 612 of the TPA member 600 can be inserted into the female housing 400. The insertion side 612 can also be referred to as the bottom of the TPA member 600. The insertion side 612 of the TPA member 600 can also be inserted into the male housing 700.

Figure 4A:
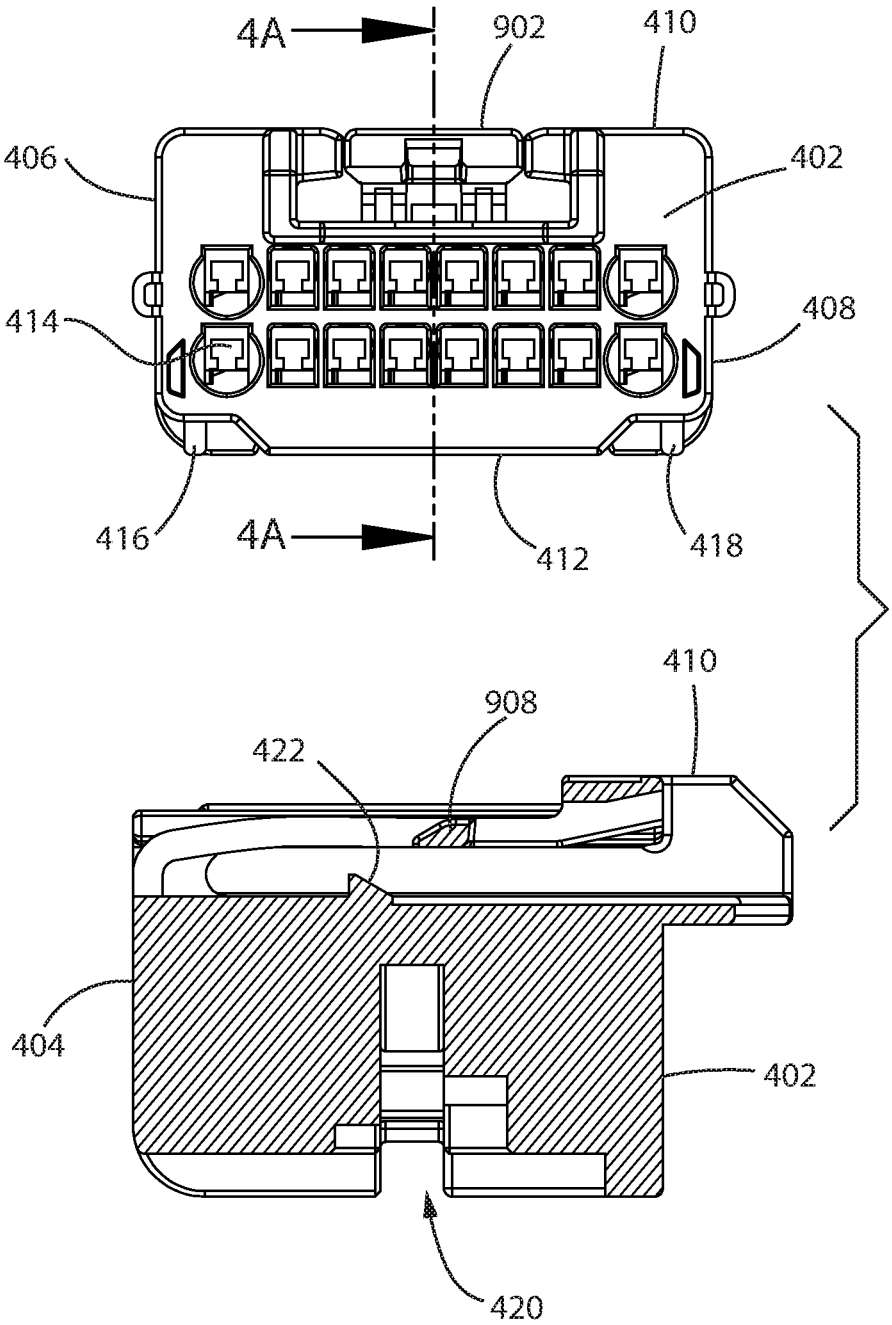
FIG. 4A includes a front end elevational view of the female housing of the connector apparatus of FIG. 3 without a TPA member and without a CPA member, and includes a cross-sectional view thereof, taken along line 4A-4A.

FIG. 4A includes a front end elevational view of the female housing of the connector apparatus of FIG. 3 without a TPA member and without a CPA member, and includes a cross-sectional view thereof, taken along line 4A-4A.

FIG. 4A has an upper view and a lower view. The upper view is a front end elevational view of the female housing 400 of the connector apparatus of FIG. 3 without a TPA member and without a CPA member. The lower view is a cross-sectional view of the upper view, taken along line 4A-4A.

The upper view of FIG. 4A shows TPA protection rib 416 and TPA protection rib 418. These TPA protection ribs help to prevent a TPA member from moving from the preset position to the final lock position during shipping and/or handling.

The upper view of FIG. 4A shows button 902 of a connector latch on female housing 400. The upper view of FIG. 4A also shows a top 410 of the female housing 400, a front end 402 of the female housing 400, a first side 406 of the female housing 400, a second side 408 of the female housing 400, a bottom 412 of the female housing 400, and a terminal aperture 414 on the front end 402 of the female housing 400.

The lower view of FIG. 4A shows a rear end 404 of the female housing 400. Also depicted is a protrusion 422 that is formed on an interior of the female housing 400. The protrusion 422 has a shape similar to that of a shark fin. The lower view of FIG. 4A shows an aperture 420 for receiving the insertion side 612 of a TPA member 600.

Figure 4B:
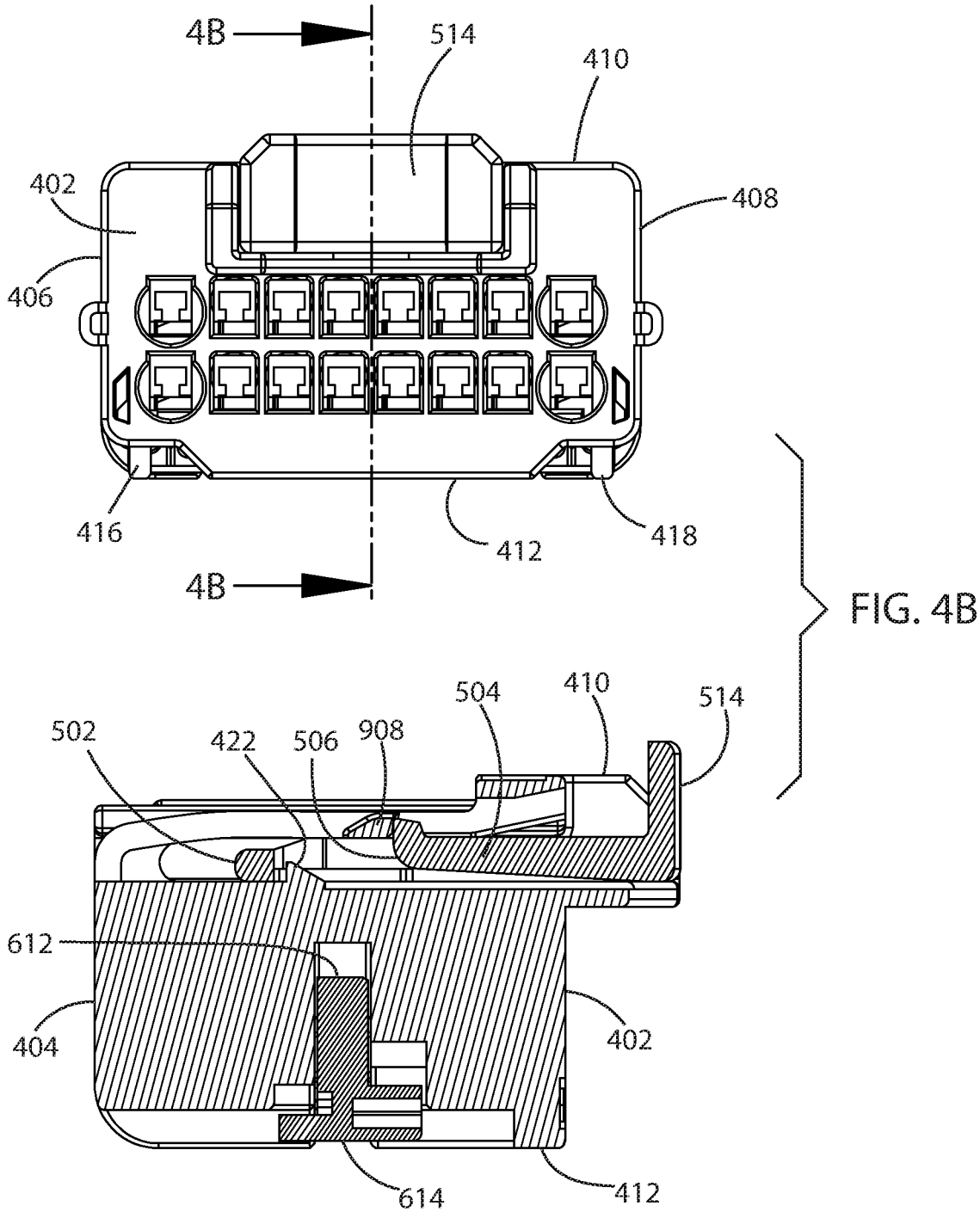
FIG. 4B includes a front end elevational view of the female housing of the connector apparatus of FIG. 3 with a TPA member in the preset position and a CPA member in the preset position, and includes a cross-sectional view thereof, taken along line 4B-4B.

FIG. 4B includes a front end elevational view of the female housing of the connector apparatus of FIG. 3 with a TPA member in the preset position and a CPA member in the preset position, and includes a cross-sectional view thereof, taken along line 4B-4B.

FIG. 4B has an upper view and a lower view. The upper view is a front end elevational view of the female housing 400 of the connector apparatus of FIG. 3 with a TPA member 600 in the preset position and a CPA member 500 in the preset position. The lower view is a cross-sectional view of the upper view, taken along line 4B-4B.

The upper view of FIG. 4B shows a rear upright portion 514 of CPA member 500. The lower view of FIG. 4B shows a front edge 502 of the CPA member 500, a central beam 504 of the CPA member 500, and a front tip 506 of the central beam 504.

As shown in the lower view of FIG. 4B, when the CPA member 500 is in the preset position, the front edge 502 is on the left of the shark fin 422, and the front tip 506 is on the right of the latch surface 908.

As shown in the lower view of FIG. 4B, when the TPA member 600 is in the preset position, the insertion side 612 is in the position indicated.

As shown in the lower view of FIG. 4B, when the TPA member 600 is in the preset position, the exposed side 614 is in the position indicated.

Figure 4C:
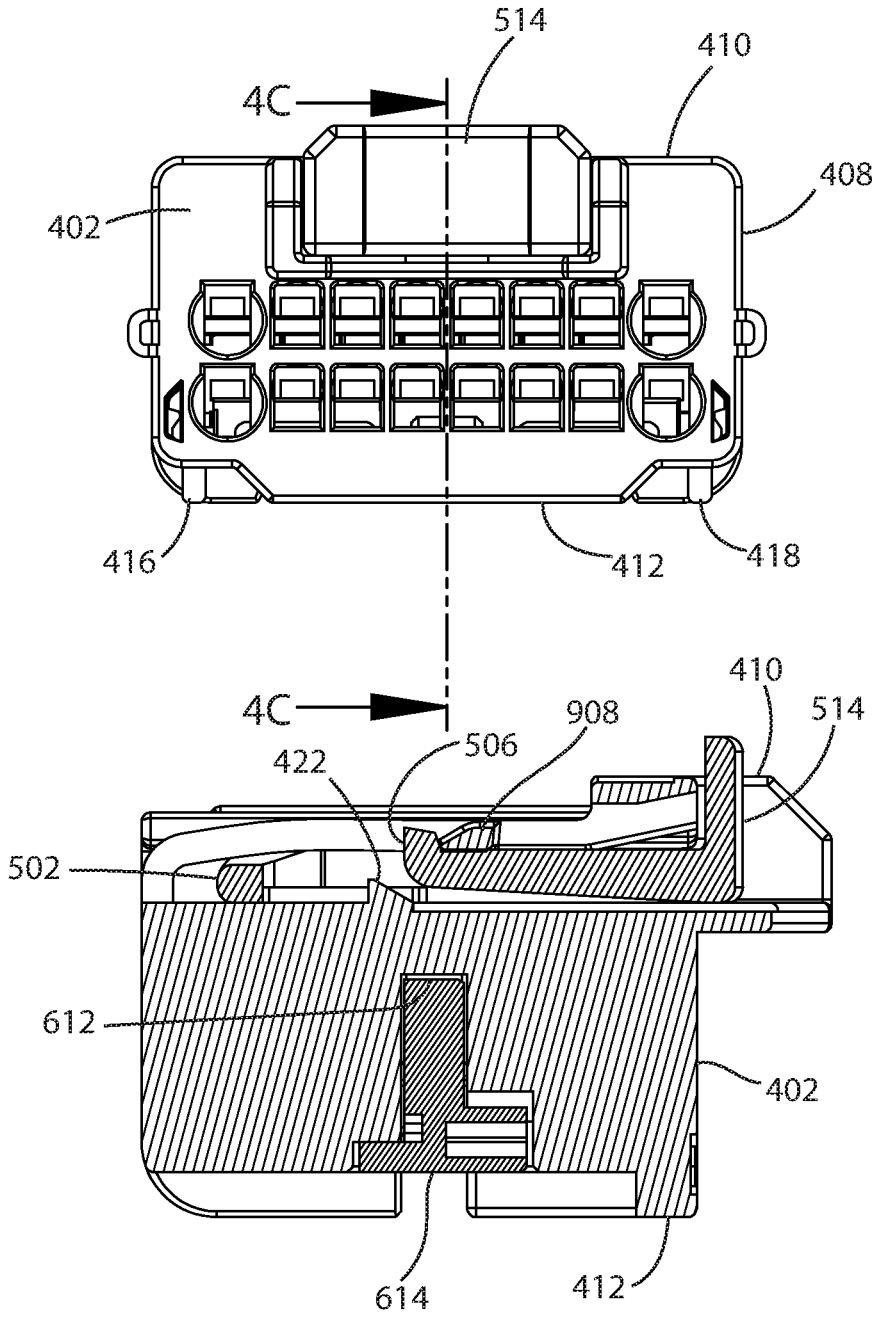
FIG. 4C includes a front end elevational view of the female housing of the connector apparatus of FIG. 3 with a TPA member in the final lock position and a CPA member in the final lock position, and includes a cross-sectional view thereof, taken along line 4C-4C.

FIG. 4C includes a front end elevational view of the female housing of the connector apparatus of FIG. 3 with a TPA member in the final lock position and a CPA member in the final lock position, and includes a cross-sectional view thereof, taken along line 4C-4C.

FIG. 4C has an upper view and a lower view. The upper view is a front end elevational view of the female housing 400 of the connector apparatus of FIG. 3 with a TPA member 600 in the final lock position and a CPA member 500 in the final lock position. The lower view is a cross-sectional view of the upper view, taken along line 4C-4C.

As shown in the lower view of FIG. 4C, when the CPA member 500 is in the final lock position, the front edge 502 is in the position indicated, and the front tip 506 is on the left side of the latch surface 908.

As shown in the lower view of FIG. 4C, when the TPA member 600 is in the final lock position, the insertion side 612 is in the position indicated.

As shown in the lower view of FIG. 4C, when the TPA member 600 is in the final lock position, the exposed side 614 is in the position indicated.

Figure 5A:
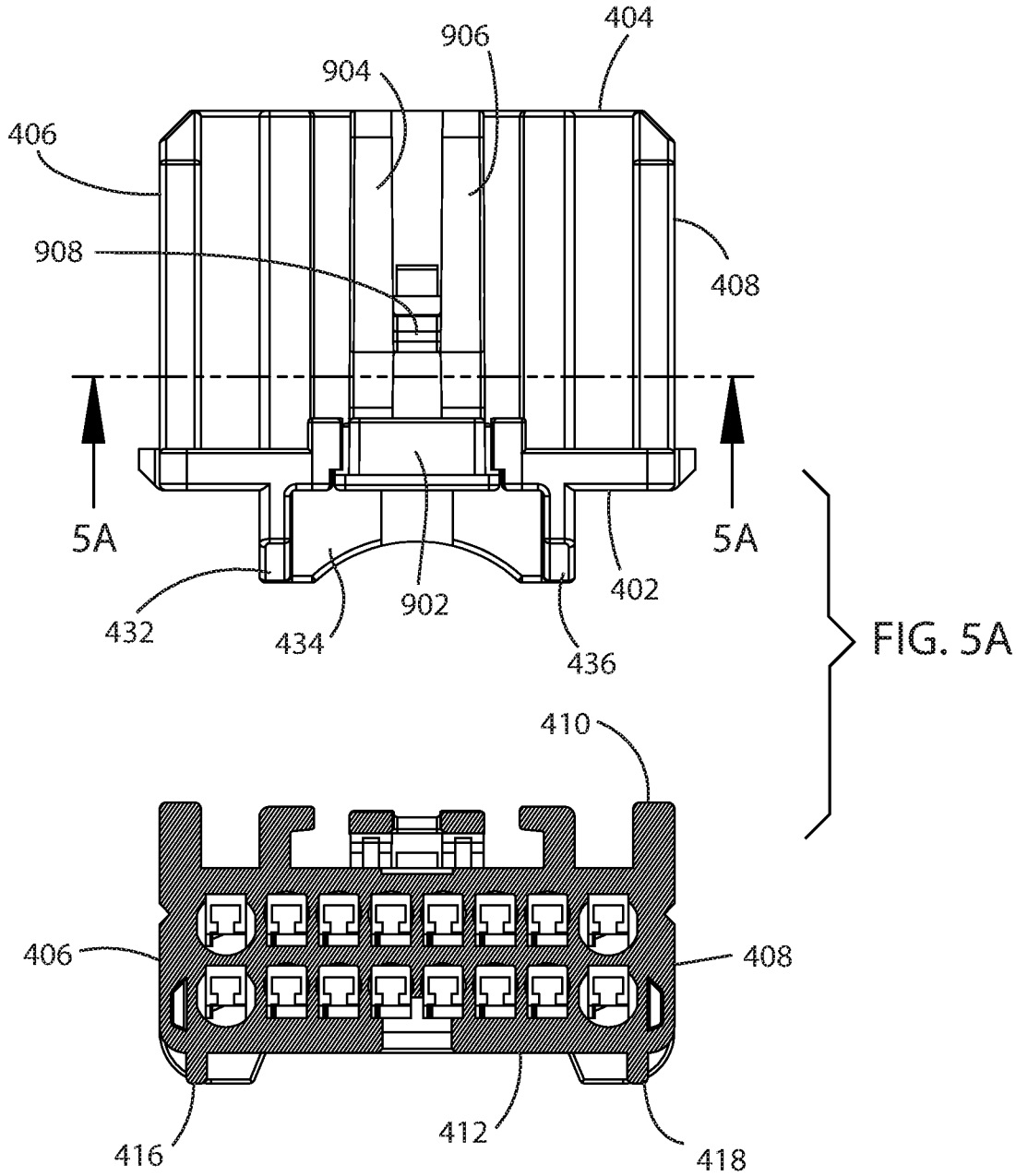
FIG. 5A includes a top elevational view of the female housing of the connector apparatus of FIG. 3 without a TPA member and without a CPA member, and includes a cross-sectional view thereof, taken along line 5A-5A.

FIG. 5A includes a top elevational view of the female housing of the connector apparatus of FIG. 3 without a TPA member and without a CPA member, and includes a cross-sectional view thereof, taken along line 5A-5A.

FIG. 5A has an upper view and a lower view. The upper view is a front end elevational view of the female housing 400 of the connector apparatus of FIG. 3 without a TPA member and without a CPA member. The lower view is a cross-sectional view of the upper view, taken along line 5A-5A.

The upper view of FIG. 5A shows CPA protection wall 432, CPA protection wall 434, and CPA protection wall 436. These CPA protection walls help to keep a CPA member 500 in a proper position, help to prevent the CPA member 500 from moving from the preset position to the final lock position or any other position during shipping and/or handling, help to prevent the CPA member 500 from getting damaged, and help to prevent the CPA member 500 from causing damage.

The upper view of FIG. 5A also shows button 902 of the connector latch of the female housing 400, first latch beam 904 of the connector latch, second latch beam 906 of the connector latch, and the latch surface 908 of the connector latch.

Figure 5B:
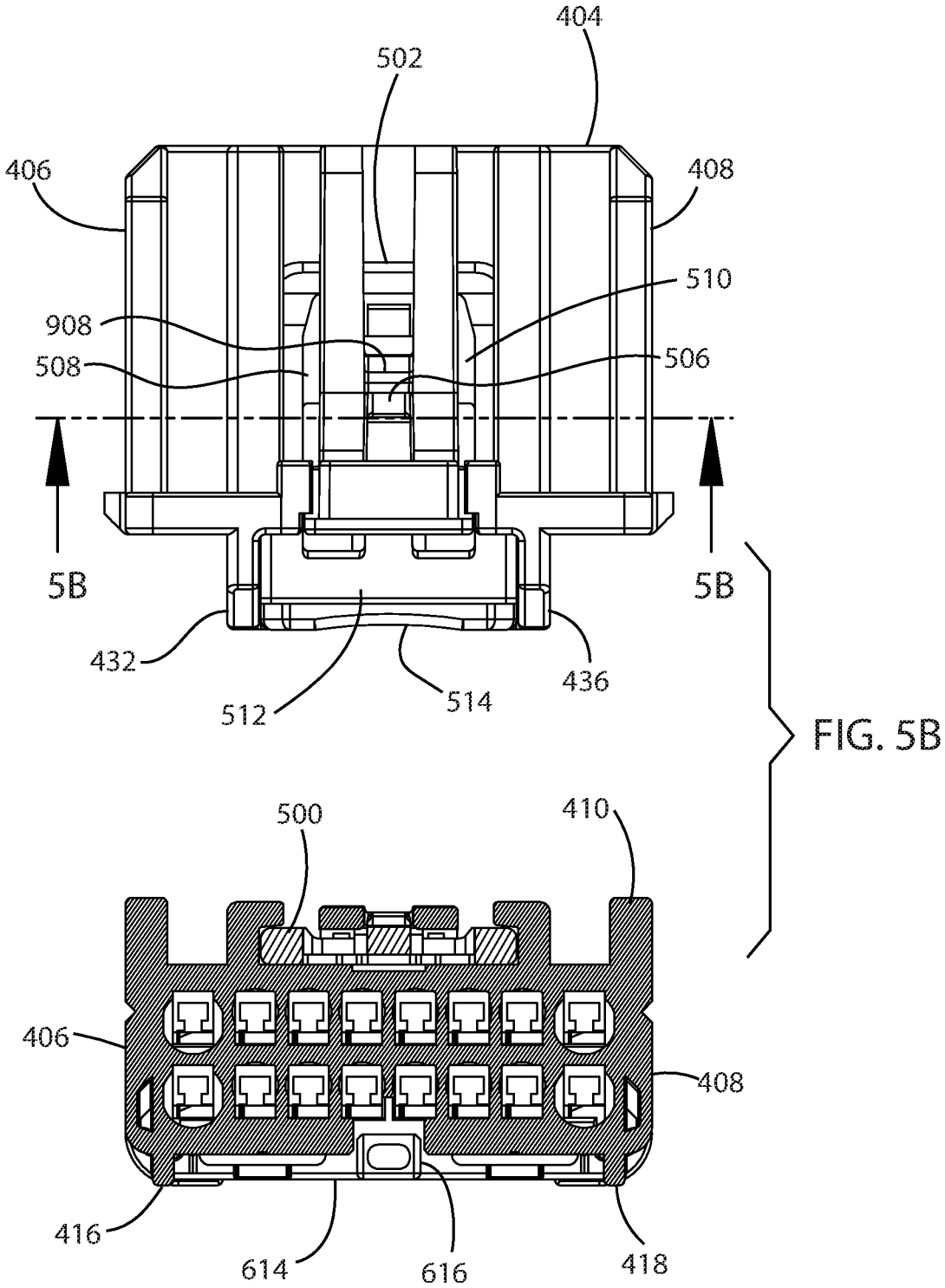
FIG. 5B includes a top elevational view of the female housing of the connector apparatus of FIG. 3 with a TPA member in the preset position and a CPA member in the preset position, and includes a cross-sectional view thereof, taken along line 5B-5B.

FIG. 5B includes a top elevational view of the female housing of the connector apparatus of FIG. 3 with a TPA member in the preset position and a CPA member in the preset position, and includes a cross-sectional view thereof, taken along line 5B-5B.

FIG. 5B includes an upper view and a lower view. The upper view is a top elevational view of the female housing 400 of the connector apparatus of FIG. 3 with a TPA member 600 in the preset position and a CPA member 500 in the preset position. The lower view is a cross-sectional view thereof, taken along line 5B-5B.

The upper view of FIG. 5B shows the following parts of the CPA member 500: a front edge 502; a first side 508; a second side 510; a rear base 512; a rear upright portion 514; and a front tip 506 of the central beam 504. In the preset position, as shown, the front tip 506 is located between the latch surface 908 and the rear upright portion 514.

The lower view of FIG. 5B shows an exposed side 614 of the TPA member 600. The exposed side 614 is also referred to as a top of the TPA member 600. The lower view of FIG. 5B also shows guide 616 of the TPA member 600.

Figure 5C:
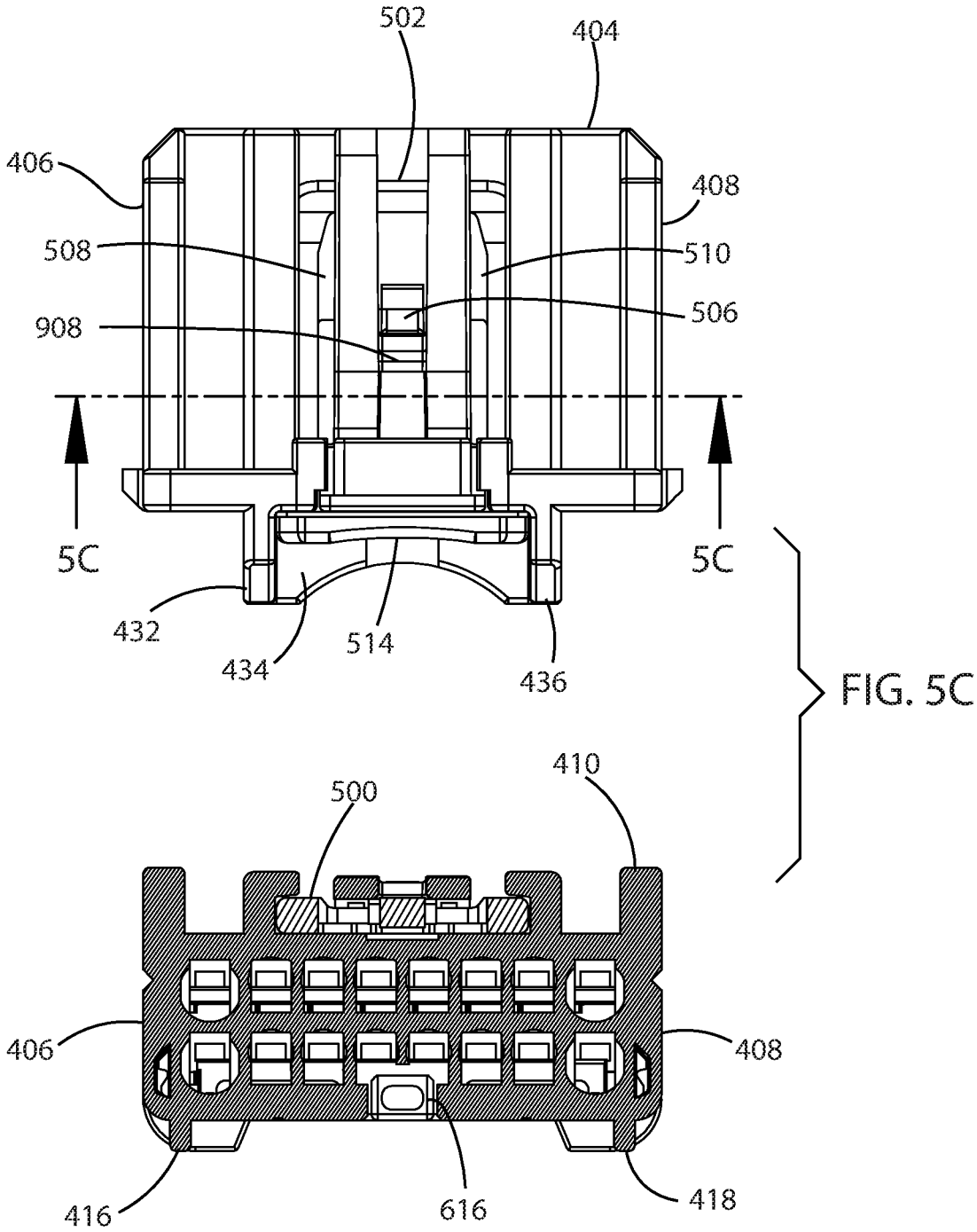
FIG. 5C includes a top elevational view of the female housing of the connector apparatus of FIG. 3 with a TPA member in the final lock position and a CPA member in the final lock position, and includes a cross-sectional view thereof, taken along line 5C-5C.

FIG. 5C includes an upper view showing a top elevational view of the female housing 400 of the connector apparatus of FIG. 3 with a TPA member 600 in the final lock position and a CPA member 500 in the final lock position, and includes a lower view showing a cross-sectional view of the upper view taken along line 5C-5C. In the final lock position, as shown, the front tip 506 is located between the latch surface 908 and the front edge 502 of the CPA member 500.

The lower view of FIG. 5C shows the TPA member 600 in the final lock position in the female housing 400.

Figure 6A:
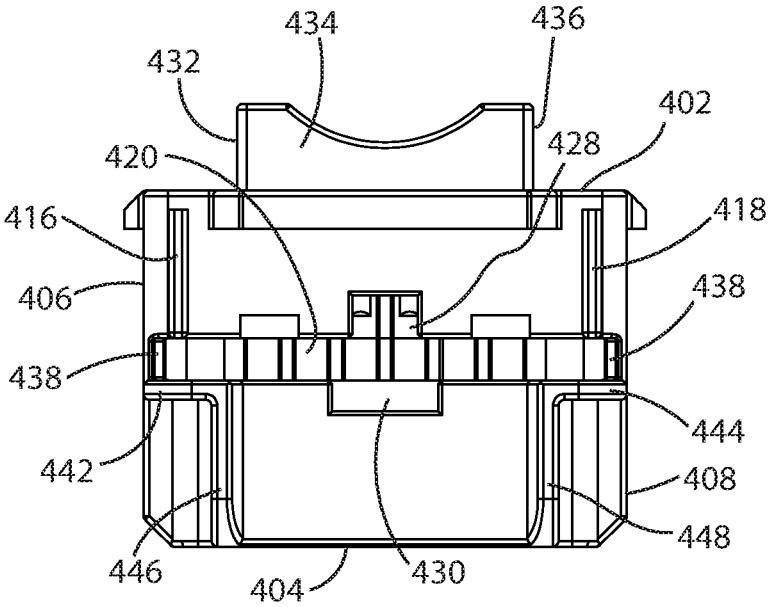
FIG. 6A is a bottom elevational view of the female housing of the connector apparatus of FIG. 3 without a TPA member and without a CPA member.

FIG. 6A is a bottom elevational view of the female housing 400 of the connector apparatus 300 of FIG. 3 without a TPA member and without a CPA member.

FIG. 6A shows CPA protection wall 432, CPA protection wall 434, and CPA protection wall 436. FIG. 6A also shows TPA protection ribs 416, 418, 442, 444, 446, and 448. Also, FIG. 6A shows a rear end 404 of the female housing 400.

FIG. 6A shows that the female housing 400 forms an aperture 420 for receiving the bottom 612 of the TPA member 600, also known as the insertion side 612 of the TPA member 600.

The female housing 400 forms aperture 428 to receive guide 616 of the TPA member 600, and also forms aperture 430 to receive guide 618 of the TPA member 600.

The female housing 400 forms two tabs 438 on an interior of the female housing 400. The two tabs 438 are visible inside aperture 420, as shown in FIG. 6A.

The male housing 700 forms aperture 720 for receiving the bottom 612 of the TPA member 800, also known as the insertion side 612 of the TPA member 800.

Figure 14A:
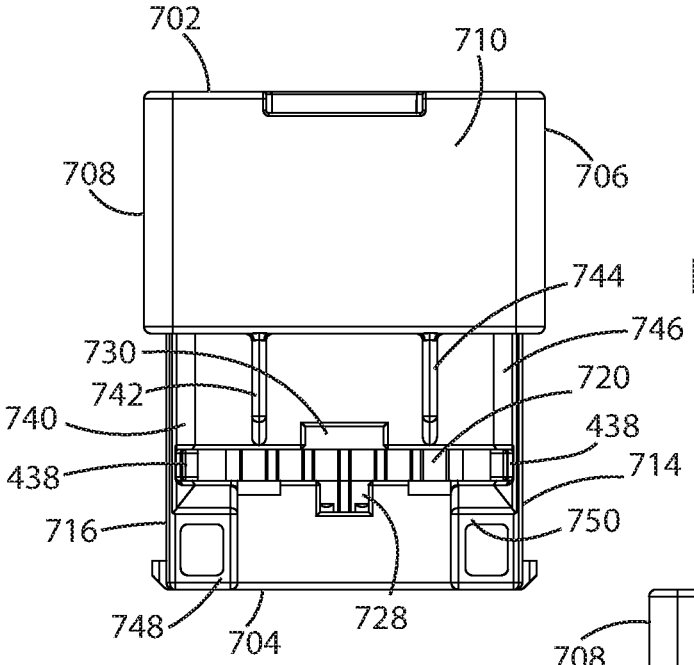
FIG. 14A is a top elevational view of the male housing of the male connector assembly of FIG. 11 without a TPA member.

The male housing 700 forms two tabs 438 on an interior of the male housing 700. The two tabs 438 are visible inside aperture 720, as shown in FIG. 14A.

Figure 11:
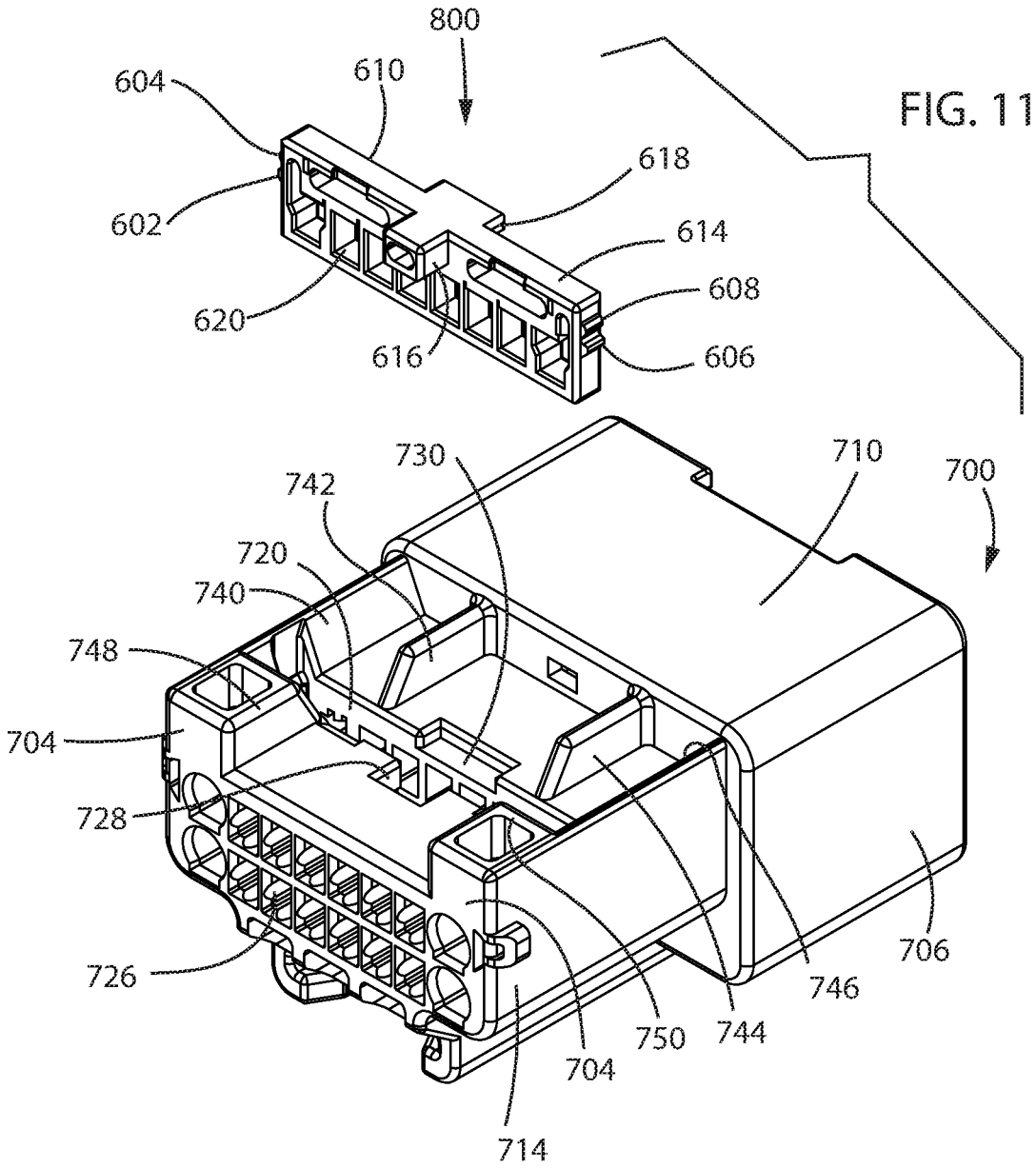
FIG. 11 is an exploded perspective view of a male connector assembly, in accordance with the principles of the present invention, showing a male housing and a TPA member for the male housing, in a sixteen-pin configuration.

TPA member 800, as shown in FIG. 11, is equivalent to the TPA member 600 shown in FIG. 3. Members 800 and 600 are both TPA members that can be used in a male housing having a sixteen-pin configuration or a female housing having a sixteen-pin configuration. The female housing 400 has a sixteen-pin configuration, as shown in FIG. 3. The male housing 700 has a sixteen-pin configuration, as shown in FIGS. 3 and 11.

Figure 26:
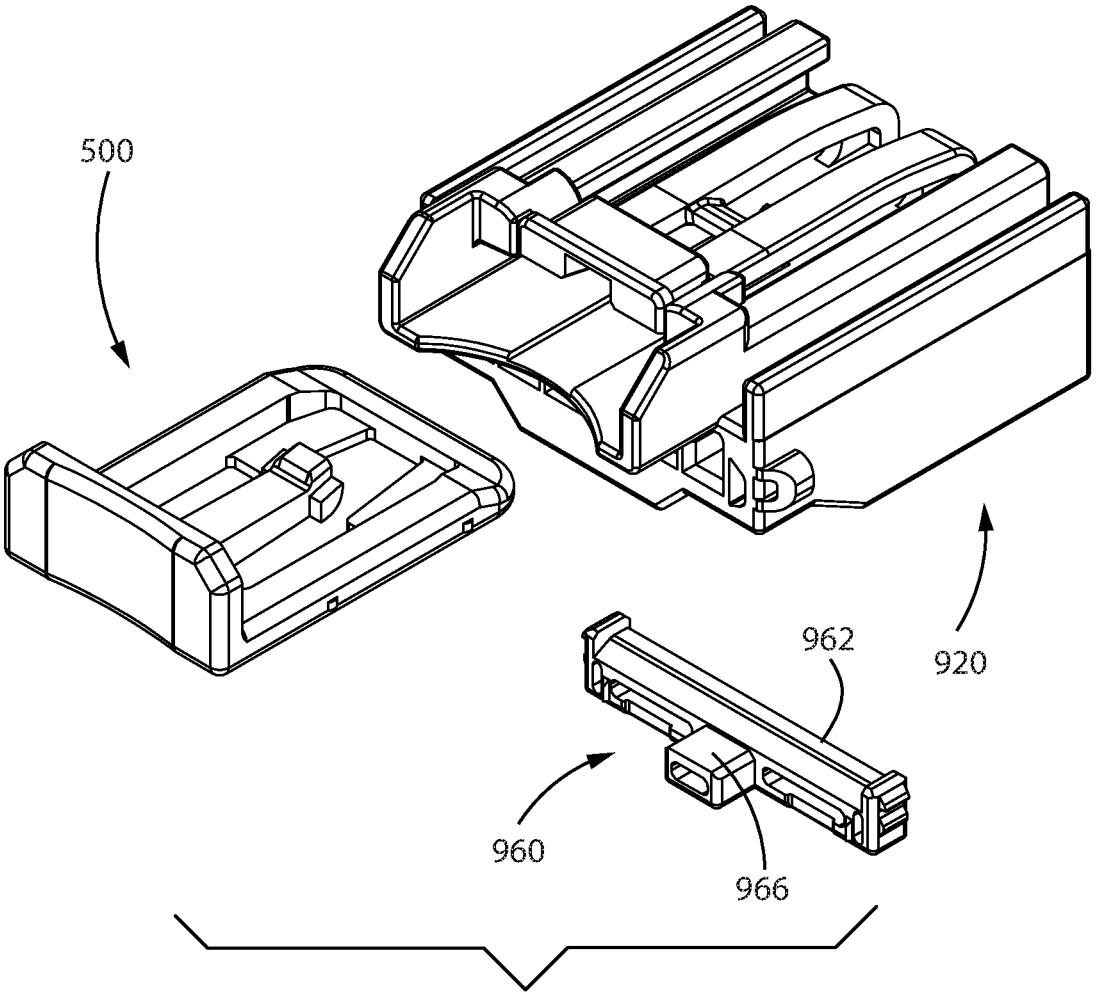
FIG. 26 is an exploded perspective view of a female connector assembly of a connector apparatus, in accordance with the principles of the present invention, showing a female housing, a TPA member for the female housing, and a CPA member for the female housing, in a six-pin configuration.
Figure 34:
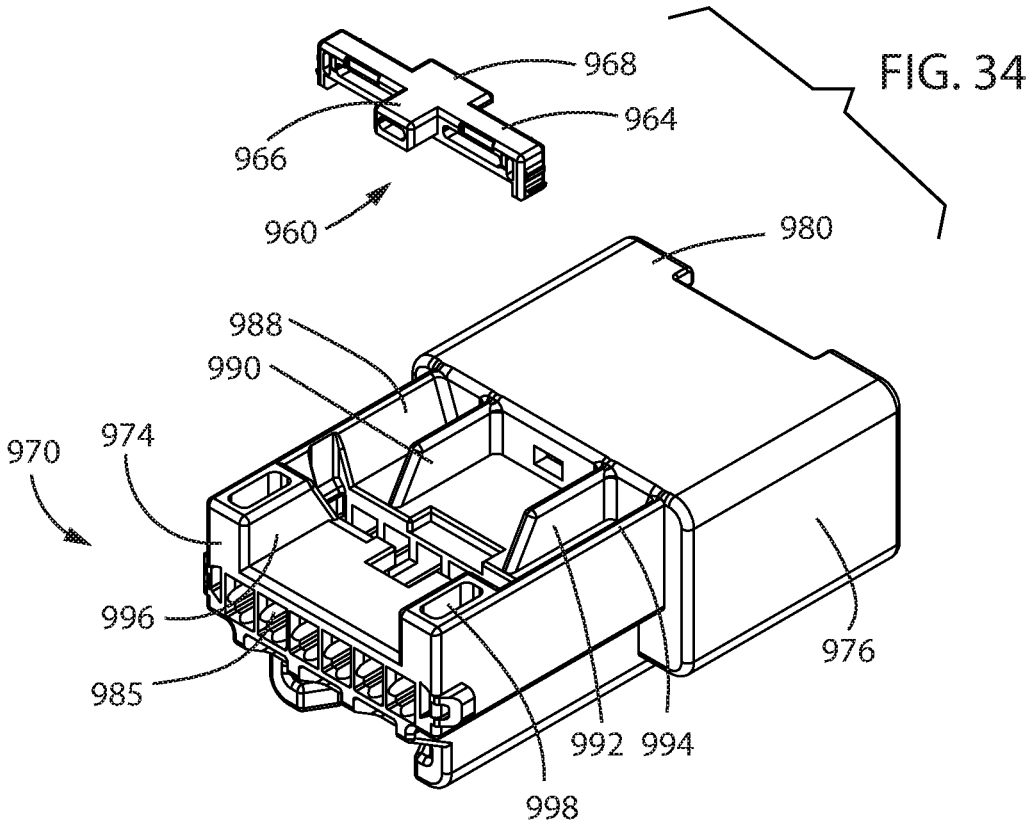
FIG. 34 is an exploded perspective view of a male connector assembly, in accordance with the principles of the present invention, showing a male housing and a TPA member for the male housing, in a six-pin configuration.

The female housing 920 has a six-pin configuration, as shown in FIG. 26. The male housing 970 has a six-pin configuration, as shown in FIG. 34. A TPA member 960 can be used for a male housing having a six-pin configuration or a female housing having a six-pin configuration. The TPA member 960 is shown in FIGS. 26 and 34, for example.

For illustration purposes, TPA member 600 is intended to be inserted into the female housing 400 of FIG. 3, and TPA member 800 is intended to be inserted into the male housing 700 of FIG. 11.

TPA member 600 and TPA member 800 each has a flexible feature 602 or protrusion 602. The flexible feature 602 is shown in FIG. 11 on TPA member 800. The same flexible feature 602 is on TPA member 600, shown in FIG. 3. Each TPA member 600, 800 also has flexible features (protrusions) 604, 606, and 608, which are shown in FIG. 11. Each TPA member 600, 800 has a body 610, a guide 616, a guide 618, an insertion side (bottom) 612, an exposed side (top) 614, and at least one terminal aperture 620. FIG. 3 shows that TPA member 600 has a plurality of terminal apertures 620. FIG. 11 shows that TPA member 800 has a plurality of terminal apertures 620.

Figure 6B:
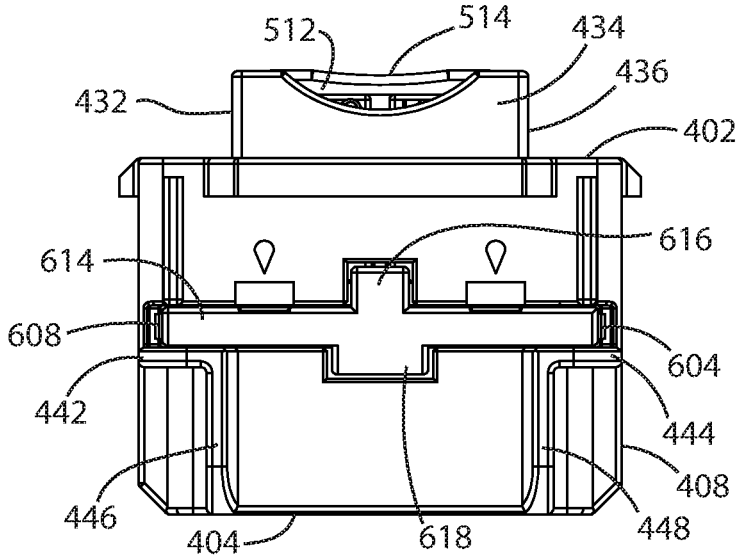
FIG. 6B is a bottom elevational view of the female housing of the connector apparatus of FIG. 3 with a TPA member in the preset position and a CPA member in the preset position.
Figure 6C:
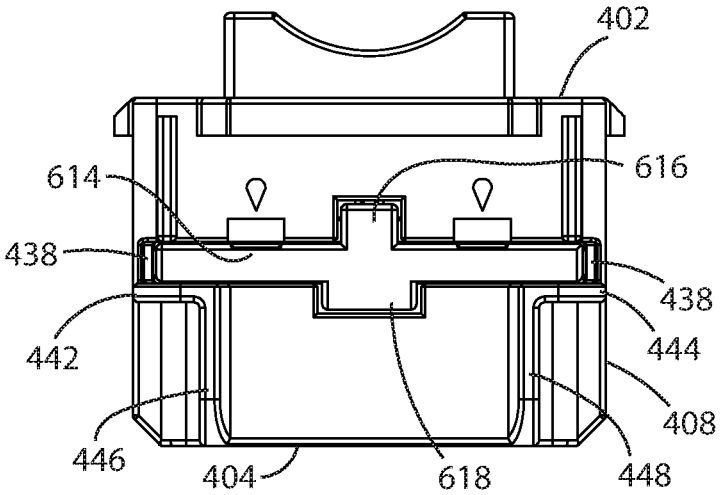
FIG. 6C is a bottom elevational view of the female housing of the connector apparatus of FIG. 3 with a TPA member in the final lock position and a CPA member in the final lock position.

When TPA member 600 is not in aperture 420 of female housing 400, tabs 438 are visible, as shown in FIG. 6A. However, when TPA member 600 is in the preset position, as shown in FIG. 6B, the tabs 438 are not visible. When TPA member 600 is in the preset position, as shown in FIG. 6B, the flexible features 604 and 608 of TPA member 600 are visible in aperture 420. When TPA member 600 is in the final lock position, as shown in FIG. 6C, the tabs 438 are visible.

Figure 14B:
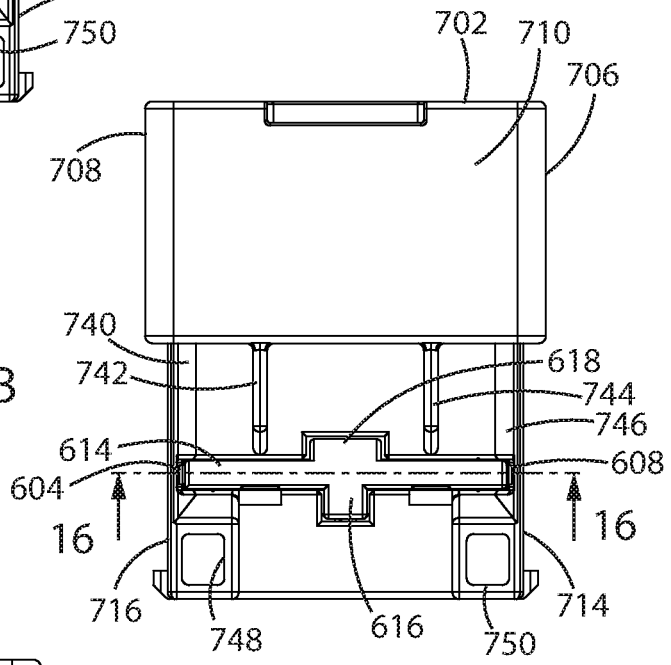
FIG. 14B is a top elevational view of the male housing of the male connector assembly of FIG. 11 with a TPA member in the preset position.
Figure 14C:
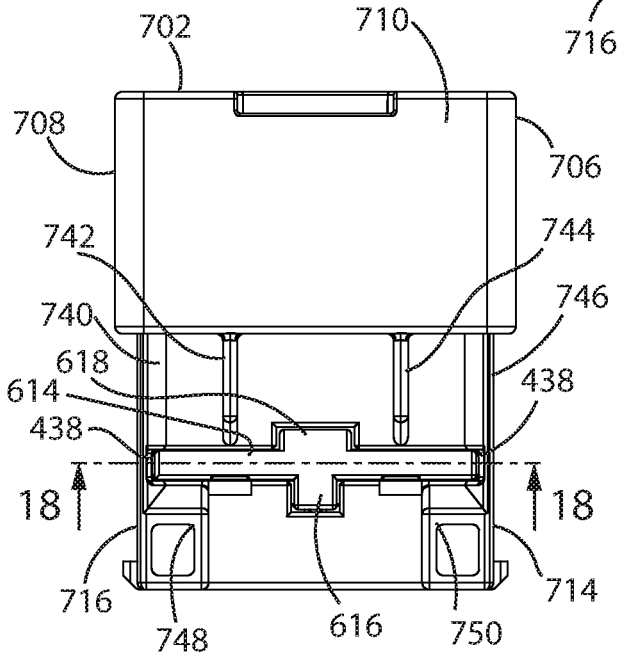
FIG. 14C is a top elevational view of the male housing of the male connector assembly of FIG. 11 with a TPA member in the final lock position.

When TPA member 800 is not in aperture 720 of male housing 700, tabs 438 are visible, as shown in FIG. 14A. However, when TPA member 800 is in the preset position, as shown in FIG. 14B, the tabs 438 are not visible. When TPA member 800 is in the preset position, as shown in FIG. 14B, the flexible features 604 and 608 of TPA member 800 are visible in aperture 720. When TPA member 800 is in the final lock position, as shown in FIG. 14C, the tabs 438 are visible.

Figure 16:
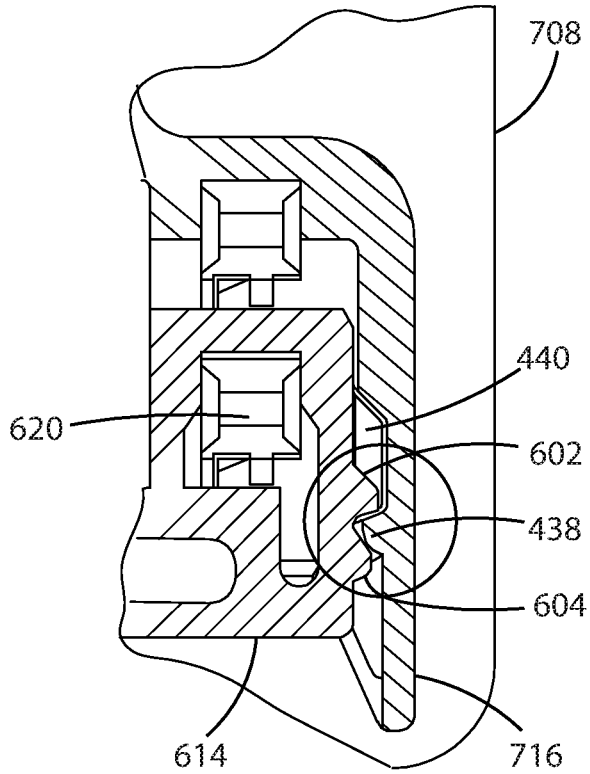
FIG. 16 is a partial cross-sectional view, taken along line 16-16 in FIG. 14B, showing details of some features of the male housing engaging with some features of the TPA member, when the TPA member is in the preset position, in accordance with the principles of the present invention.
Figure 17:
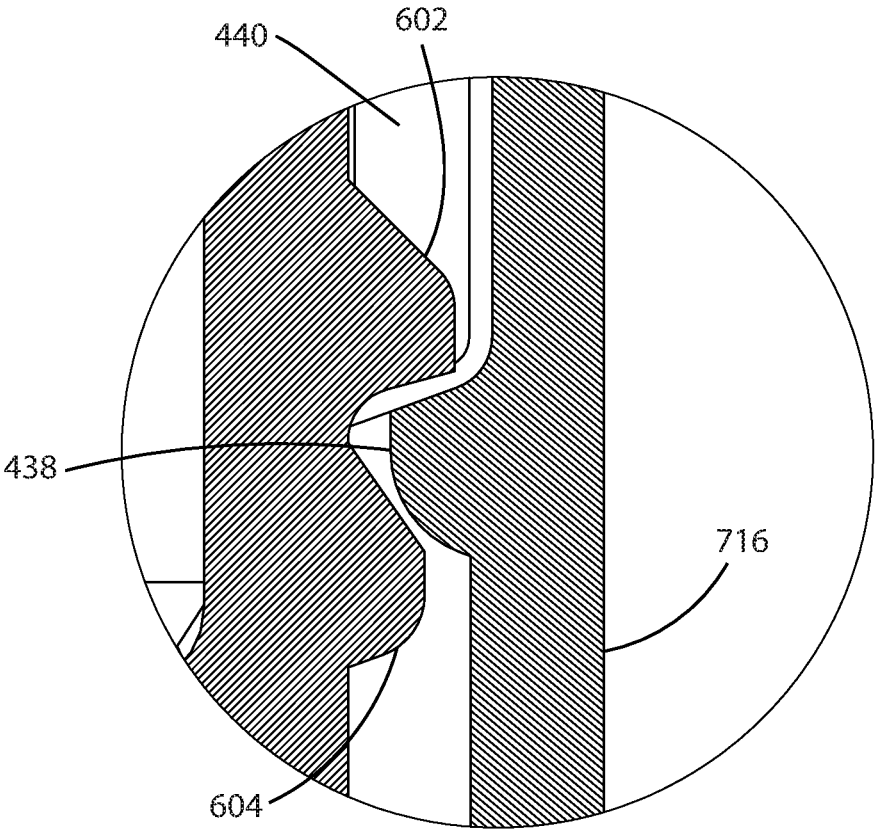
FIG. 17 is an enlarged view of the portion denoted in FIG. 16.
Figure 18:
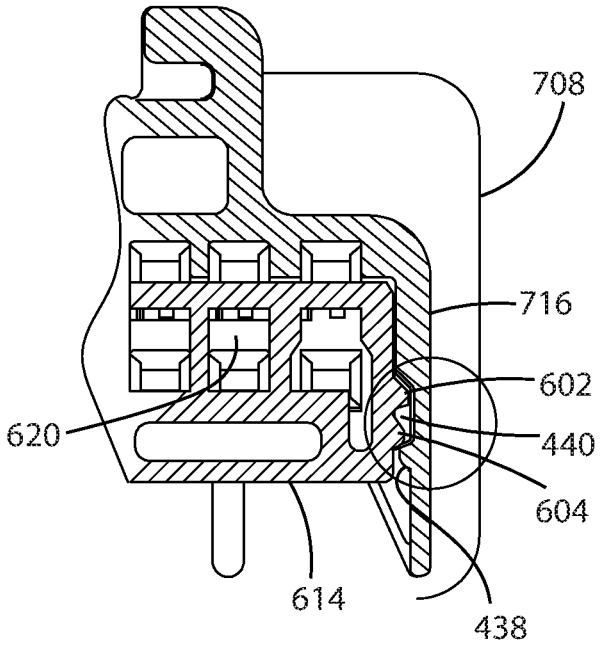
FIG. 18 is a partial cross-sectional view, taken along line 18-18 in FIG. 14C, showing details of some features of the male housing engaging with some features of the TPA member, when the TPA member is in the final lock position, in accordance with the principles of the present invention.
Figure 19:
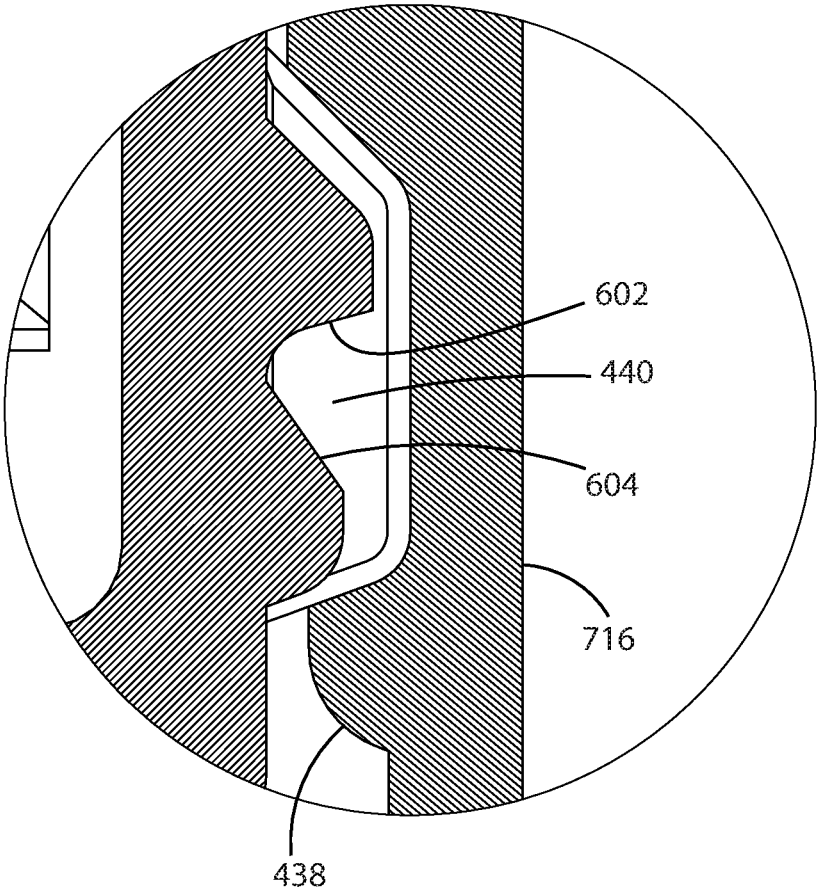
FIG. 19 is an enlarged view of the portion denoted in FIG. 18.

For the preset position, the relationship between tab 438 and flexible features 602 and 604 is shown in FIGS. 16 and 17. For the final lock position, the relationship between tab 438 and flexible features 602 and 604 is shown in FIGS. 18 and 19.

FIG. 6B is a bottom elevational view of the female housing 400 of the connector apparatus of FIG. 3 with a TPA member 600 in the preset position and a CPA member 500 in the preset position. Flexible features 604 and 608 are visible on TPA member 600.

FIG. 6C is a bottom elevational view of the female housing 400 of the connector apparatus of FIG. 3 with a TPA member 600 in the final lock position and a CPA member 500 in the final lock position. Tabs 438 are visible on the interior of the female housing 400, in aperture 420.

Figure 7A:
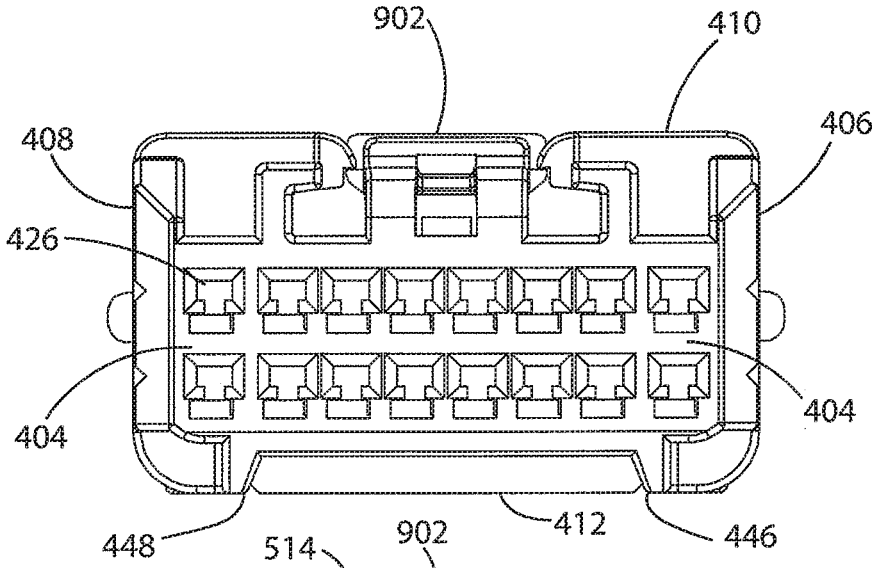
FIG. 7A is a rear end elevational view of the female housing of the connector apparatus of FIG. 3 without a TPA member and without a CPA member.

FIG. 7A is a rear end elevational view of the female housing 400 of the connector apparatus 300 of FIG. 3 without a TPA member and without a CPA member. The female housing 400 has a plurality of terminal apertures 426.

Figure 7B:
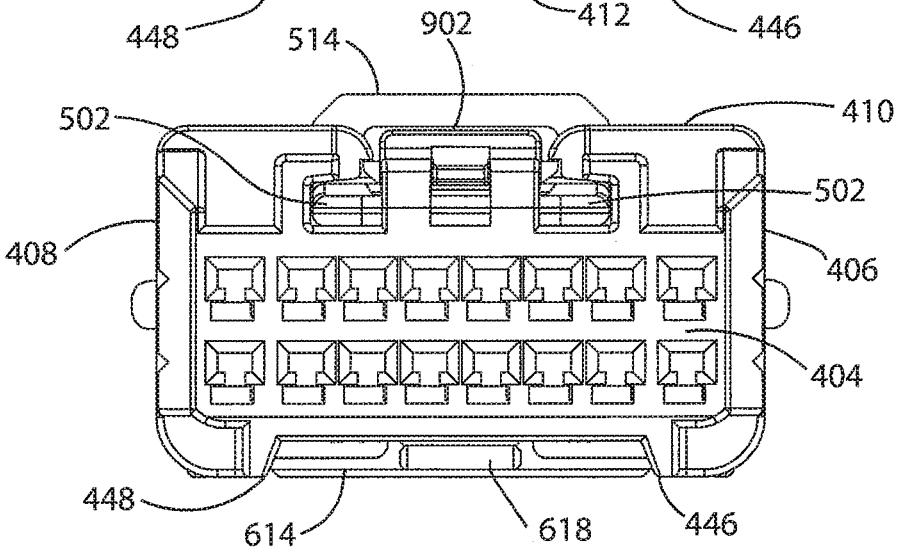
FIG. 7B is a rear end elevational view of the female housing of the connector apparatus of FIG. 3 with a TPA member in the preset position and a CPA member in the preset position.

FIG. 7B is a rear end elevational view of the female housing 400 of the connector apparatus 300 of FIG. 3 with a TPA member 600 in the preset position and a CPA member 500 in the preset position.

Figure 7C:
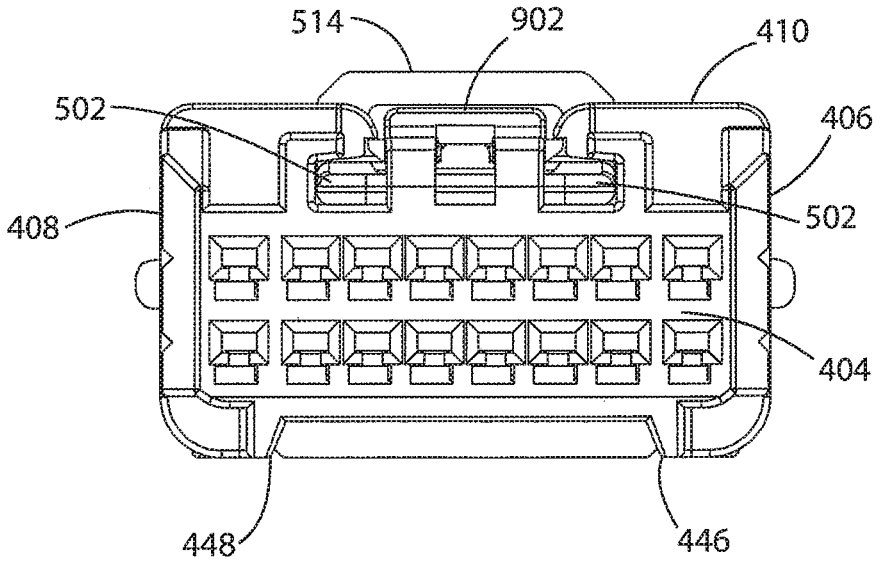
FIG. 7C is a rear end elevational view of the female housing of the connector apparatus of FIG. 3 with a TPA member in the final lock position and a CPA member in the final lock position.

FIG. 7C is a rear end elevational view of the female housing 400 of the connector apparatus 300 of FIG. 3 with a TPA member 600 in the final lock position and a CPA member 500 in the final lock position.

Figure 8A:
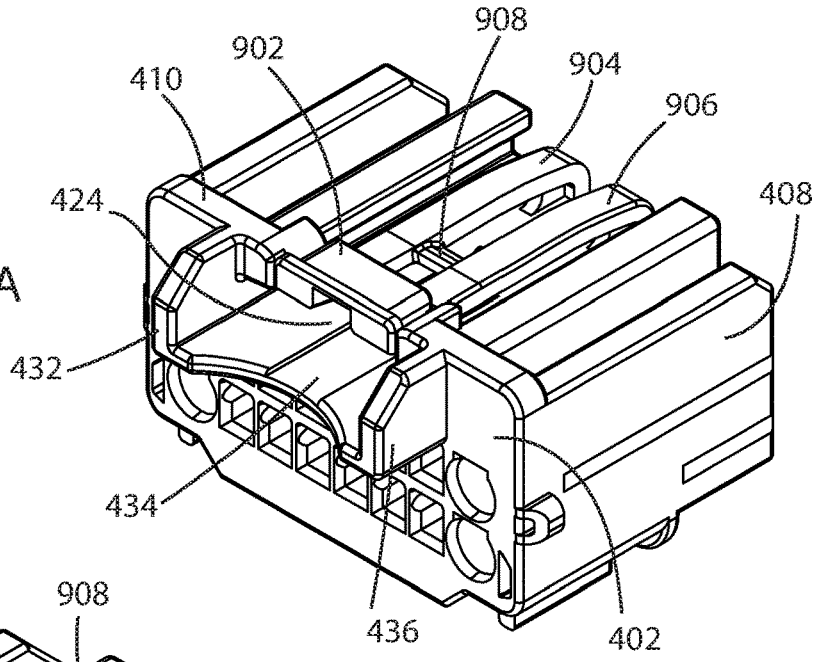
FIG. 8A is a perspective view of the female housing of the connector apparatus of FIG. 3 without a TPA member and without a CPA member.

FIG. 8A is a perspective view of the female housing 400 of the connector apparatus 300 of FIG. 3 without a TPA member and without a CPA member. The female housing 400 forms an aperture 424 for receiving CPA member 500. The entrance area of aperture 424 is bordered by CPA protection walls 432, 434, and 436, as shown in FIG. 8A.

Figure 8B:
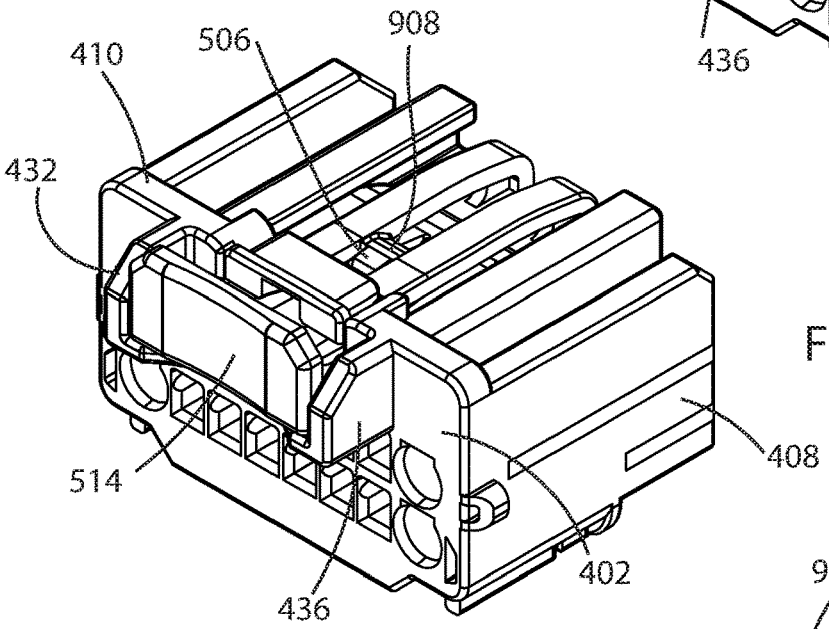
FIG. 8B is a perspective view of the female housing of the connector apparatus of FIG. 3 with a TPA member in the preset position and a CPA member in the preset position.

FIG. 8B is a perspective view of the female housing 400 of the connector apparatus 300 of FIG. 3 with a TPA member 600 in the preset position and a CPA member 500 in the preset position.

Figure 8C:
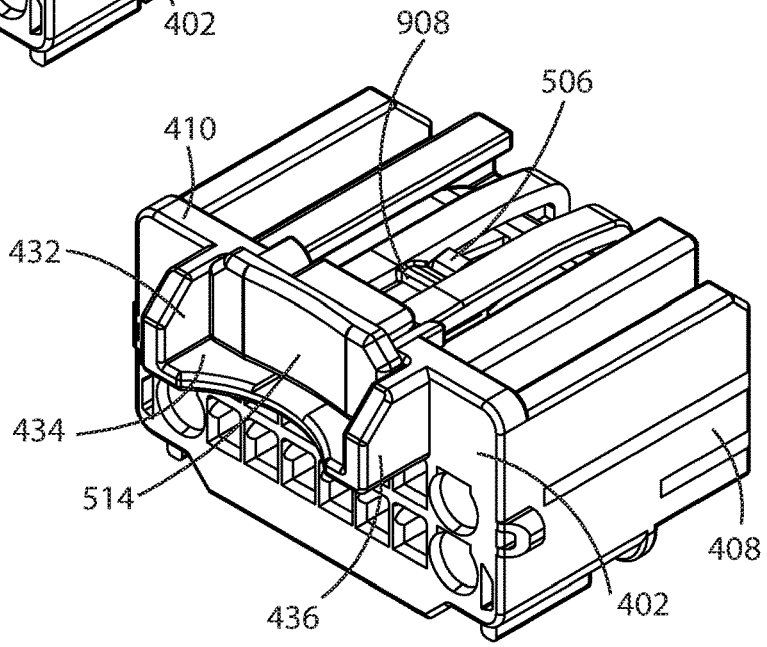
FIG. 8C is a perspective view of the female housing of the connector apparatus of FIG. 3 with a TPA member in the final lock position and a CPA member in the final lock position.

FIG. 8C is a perspective view of the female housing 400 of the connector apparatus 300 of FIG. 3 with a TPA member 600 in the final lock position and a CPA member 500 in the final lock position.

Figure 9A:
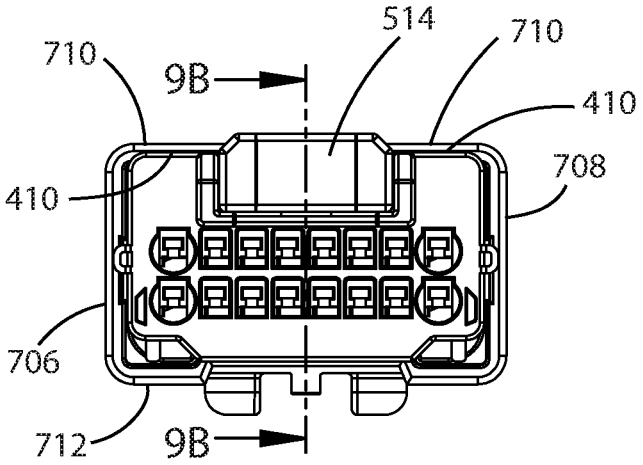
FIG. 9A is a front end elevational view of the female housing and male housing of FIG. 3 mated together showing the female housing with a CPA member in the preset position, without a TPA member in the female housing and without a TPA member in the male housing.

FIG. 9A is a front end elevational view of the female housing 300 and male housing 700 of FIG. 3 mated together showing the female housing 300 with a CPA member 500 in the preset position. As shown in FIG. 9A, the female housing 300 does not have a TPA member 600 and the male housing 700 does not have a TPA member 800.

FIG. 9A shows the top 410 of the female housing 400, and also shows the following features of the male housing 700: top 710; bottom 712; first side 706; and second side 708.

Figure 9B:
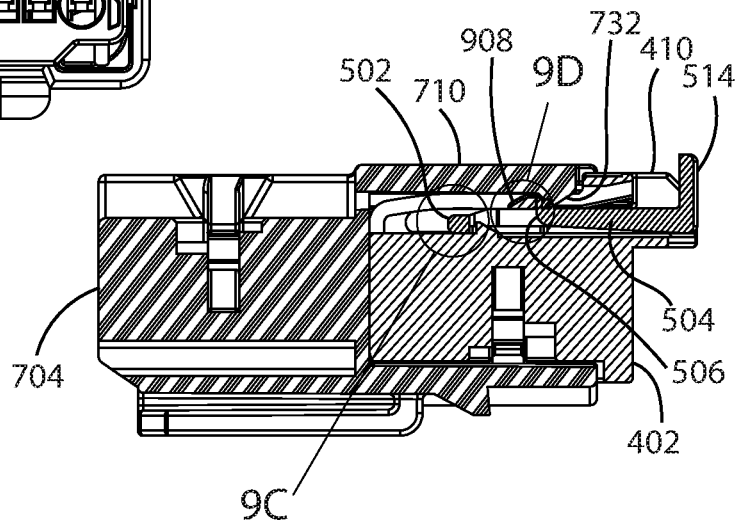
FIG. 9B is a cross-sectional view, taken along line 9B-9B in FIG. 9A.

FIG. 9B is a cross-sectional view, taken along line 9B-9B in FIG. 9A. FIG. 9B shows rear end 704 of the male housing 700, and shows protrusion 732 formed by the male housing 700. Protrusion 732 has a shape similar to that of a shark fin. FIG. 9B shows central beam 504 of CPA member 500.

Figure 9C:
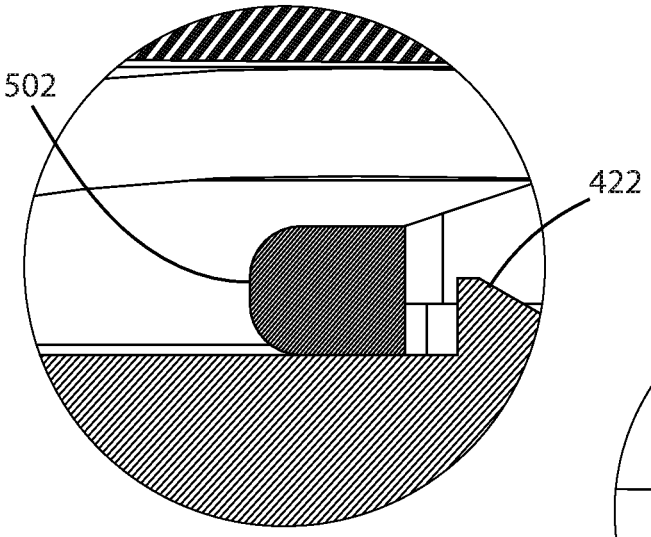
FIG. 9C is an enlarged view of the portion denoted 9C in FIG. 9B.
Figure 9D:
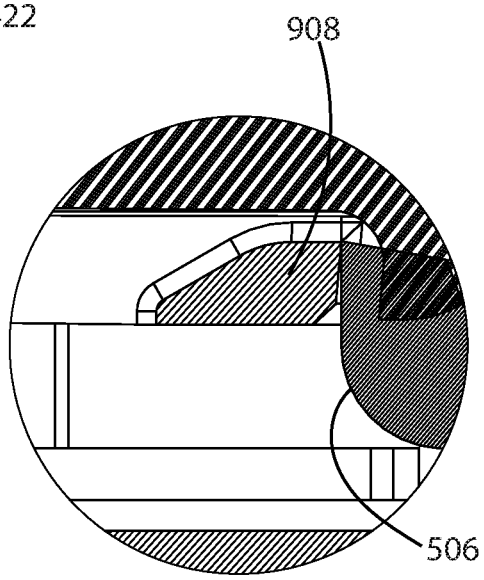
FIG. 9D is an enlarged view of the portion denoted 9D in FIG. 9B.

FIG. 9C is an enlarged view of the portion denoted 9C in FIG. 9B. FIG. 9D is an enlarged view of the portion denoted 9D in FIG. 9B.

The CPA 500 is not typically inserted into aperture 424 of the female housing 300 until after the female housing 300 is mated with the male housing 700. FIGS. 4B, 4C, 5B, 5C, 6B, 6C, 7B, 7C, 8B, and 8C, for example, appear to depict a situation where CPA member 500 is inserted into a female housing 300 at a time when the female housing 300 is not yet mated with the male housing 700, and thus are for illustrative purposes only.

Figure 10A:
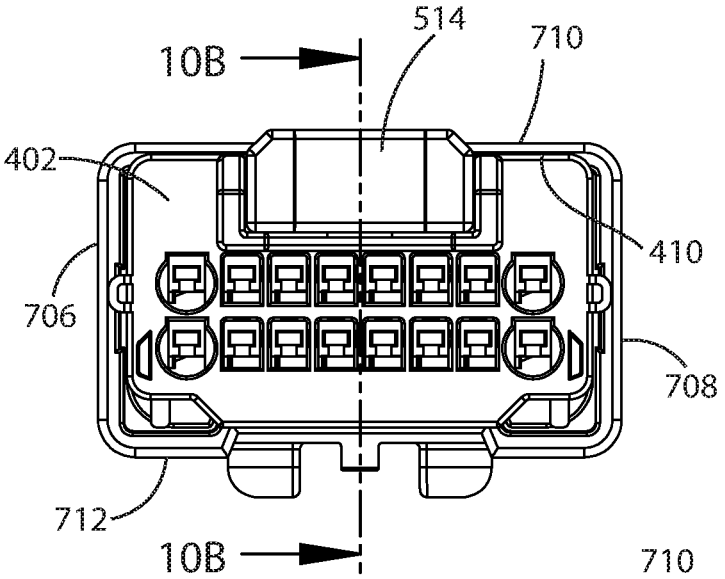
FIG. 10A is a front elevational view of the female housing and male housing of FIG. 3 mated together showing the female housing with a CPA member in the final lock position, without a TPA member in the female housing and without a TPA member in the male housing.
Figure 10B:
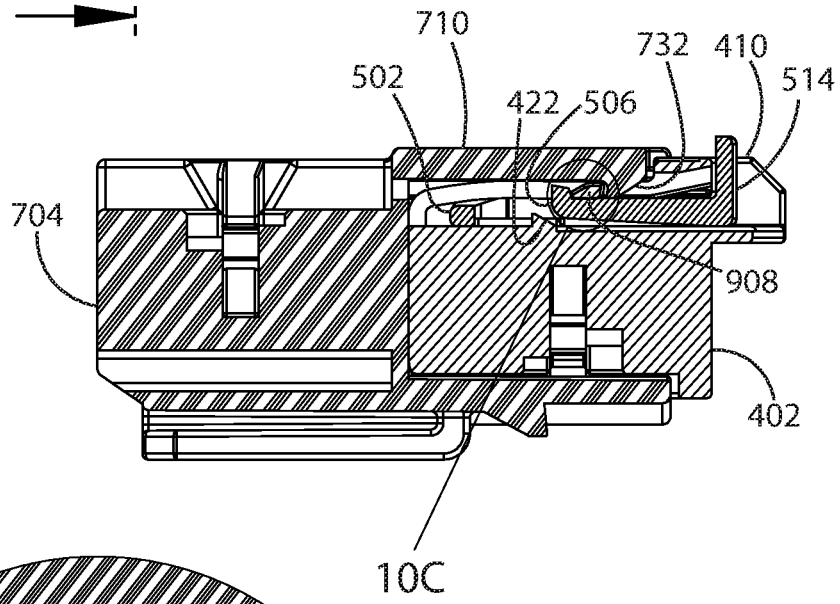
FIG. 10B is a cross-sectional view, taken along line 10B-10B in FIG. 10A.
Figure 10C:
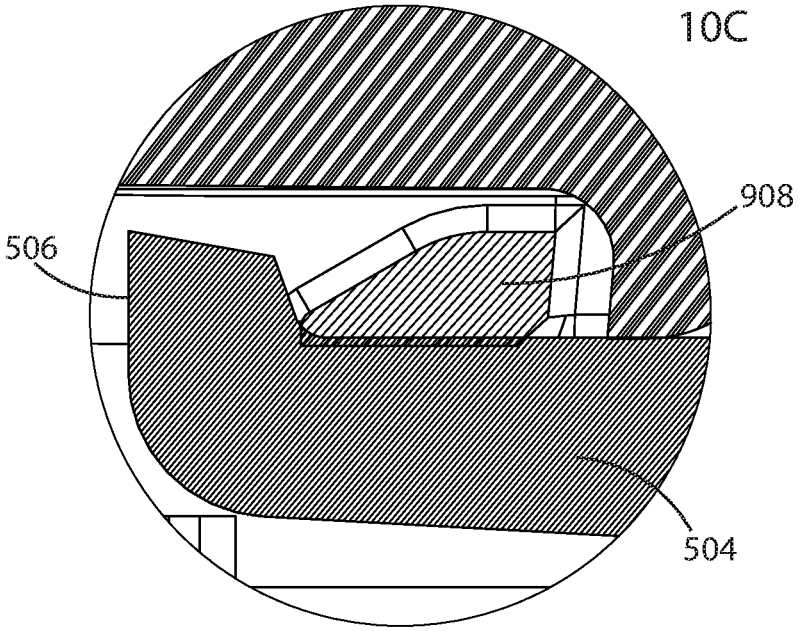
FIG. 10C is an enlarged view of the portion denoted 10C in FIG. 10B.

FIG. 10A is a front elevational view of the female housing 400 and male housing 700 of FIG. 3 mated together showing the female housing 300 with CPA member 500 in the final lock position, without a TPA member in the female housing 300 and without a TPA member in the male housing 700. FIG. 10B is a cross-sectional view, taken along line 10B-10B in FIG. 10A. FIG. 10C is an enlarged view of the portion denoted 10C in FIG. 10B.

FIG. 11 is an exploded perspective view of a male connector assembly, in accordance with the principles of the present invention, showing a male housing 700 and a TPA member 800 for the male housing 700, in a sixteen-pin configuration.

TPA member 800 has a flexible feature 602 or protrusion 602. TPA member 800 also has flexible features (protrusions) 604, 606, and 608, which are shown in FIG. 11. TPA member 800 has a body 610, a guide 616, a guide 618, an insertion side (bottom) 612, an exposed side (top) 614, and at least one terminal aperture 620.

FIG. 11 shows that the male housing 700 has TPA protection ribs 740, 742, 744, 746, 748, and 750.

FIG. 11 shows that the male housing 700 has a rear end 704, a plurality of terminal apertures 726, and an aperture 720 for receiving TPA member 800. The male housing 700 forms aperture 728 for receiving guide 616 of TPA member 800, and forms aperture 730 for receiving guide 618 of TPA member 800. FIG. 11 also shows side 714 of the male housing 700.

Figure 12A:
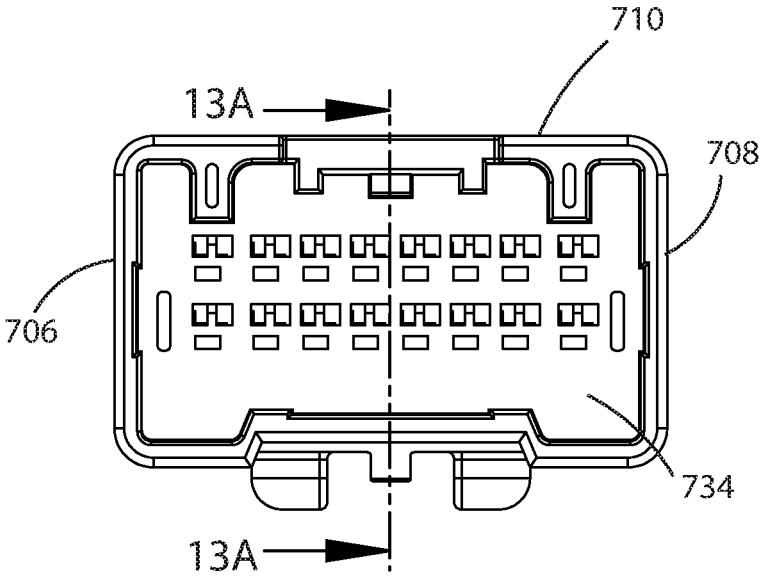
FIG. 12A is a front end elevational view of the male housing of the male connector assembly of FIG. 11 without a TPA member.
Figure 12B:
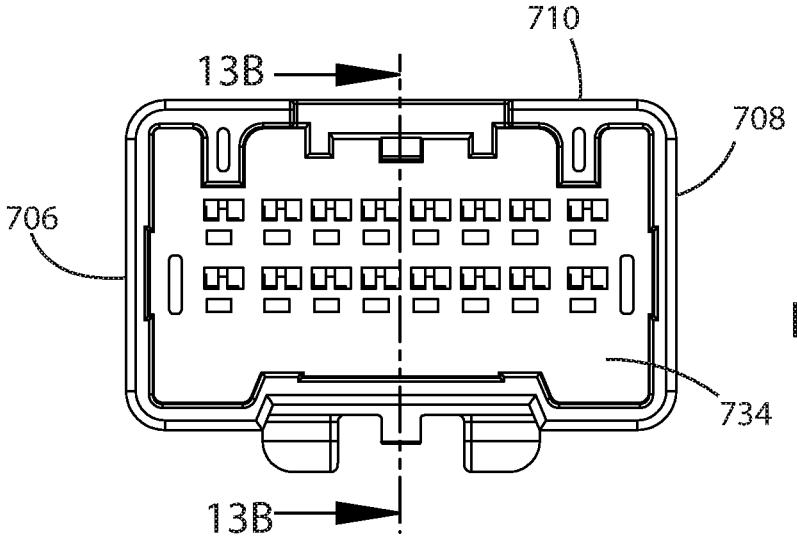
FIG. 12B is a front end elevational view of the male housing of the male connector assembly of FIG. 11 with a TPA member in the preset position.
Figure 12C:
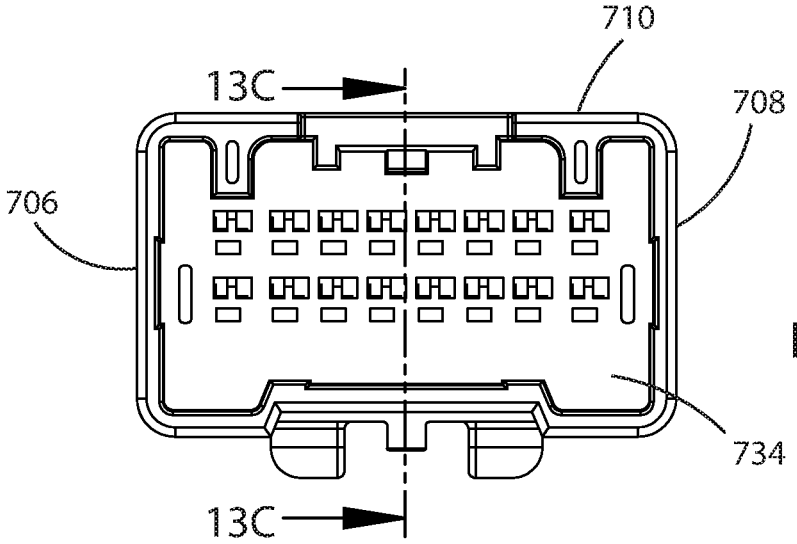
FIG. 12C is a front end elevational view of the male housing of the male connector assembly of FIG. 11 with a TPA member in the final lock position.

FIG. 12A is a front end elevational view of the male housing 700 of the male connector assembly of FIG. 11 without a TPA member. FIG. 12A shows aperture 734 in male housing 700, intended to receive the rear end 404 of the female housing 400. FIG. 12B is a front end elevational view of the male housing 700 of the male connector assembly of FIG. 11 with a TPA member 800 in the preset position. FIG. 12C is a front end elevational view of the male housing 700 of the male connector assembly of FIG. 11 with a TPA member 800 in the final lock position.

Figure 13A:
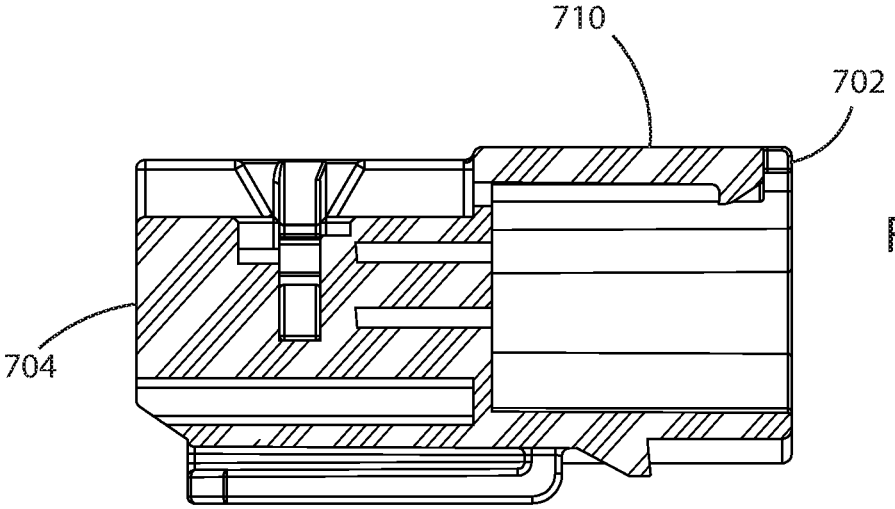
FIG. 13A is a cross-sectional view, taken along line 13A-13A in FIG. 12A.

FIG. 13A is a cross-sectional view, taken along line 13A-13A in FIG. 12A. FIG. 13A shows front end 702 of the male housing 700.

Figure 13B:
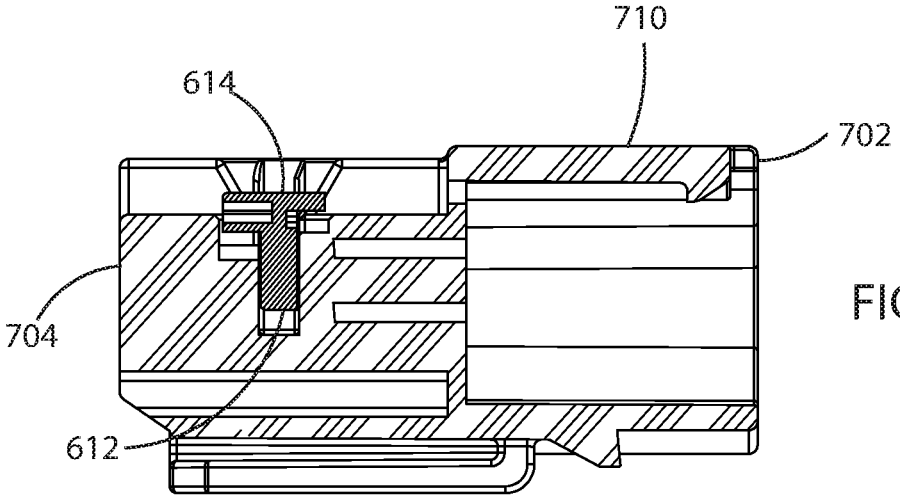
FIG. 13B is a cross-sectional view, taken along line 13B-13B in FIG. 12B.

FIG. 13B is a cross-sectional view, taken along line 13B-13B in FIG. 12B. FIG. 13B shows TPA member 800 in the preset position.

Figure 13C:
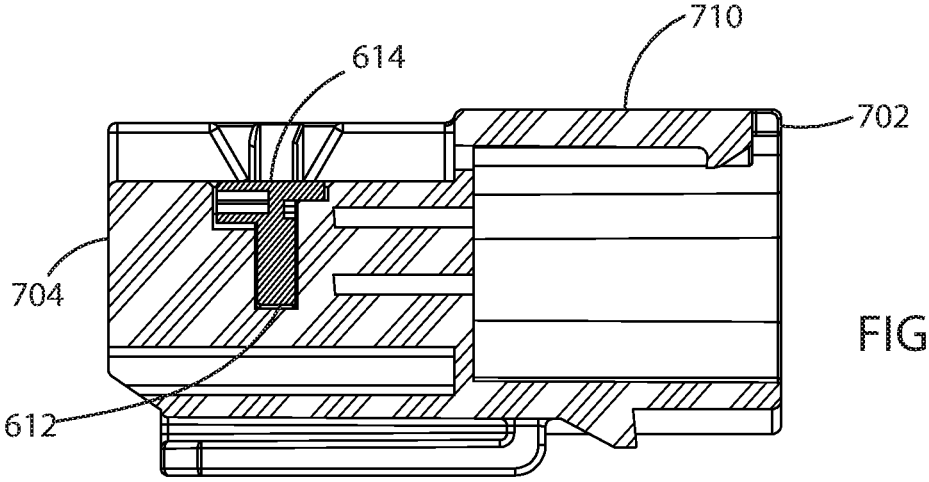
FIG. 13C is a cross-sectional view, taken along line 13C-13C in FIG. 12C.

FIG. 13C is a cross-sectional view, taken along line 13C-13C in FIG. 12C. FIG. 13C shows TPA member 800 in the final lock position.

FIG. 14A is a top elevational view of the male housing 700 of the male connector assembly of FIG. 11 without a TPA member. FIG. 14A shows side 714 and side 716 of the male housing 700.

FIG. 14B is a top elevational view of the male housing 700 of the male connector assembly of FIG. 11 with TPA member 800 in the preset position. FIG. 14C is a top elevational view of the male housing 700 of the male connector assembly of FIG. 11 with TPA member 800 in the final lock position.

Figure 15A:
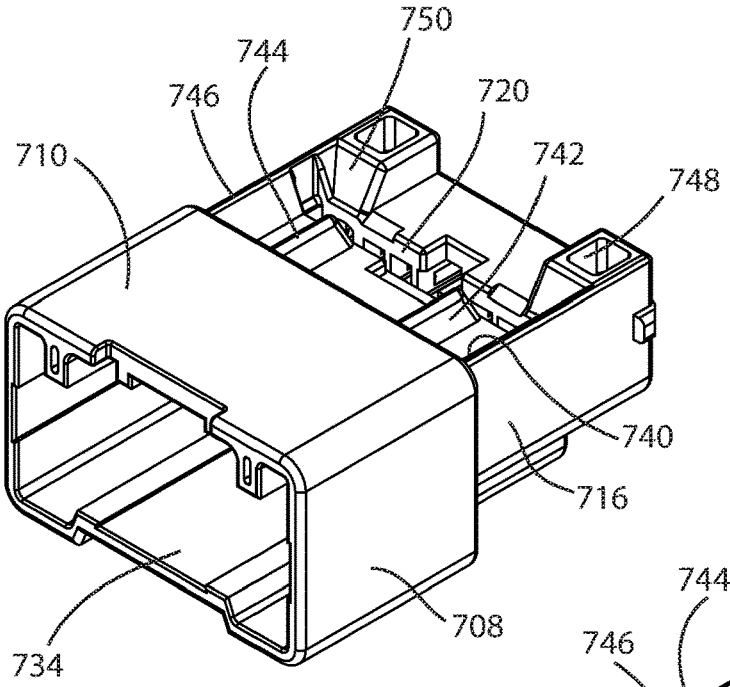
FIG. 15A is a perspective view of the male housing of the male connector assembly of FIG. 11 without a TPA member.

FIG. 15A is a perspective view of the male housing 700 of the male connector assembly of FIG. 11 without a TPA member. FIG. 15A shows the aperture 734 in the male housing 700, which receives the rear end 404 of the female housing 400.

Figure 15B:
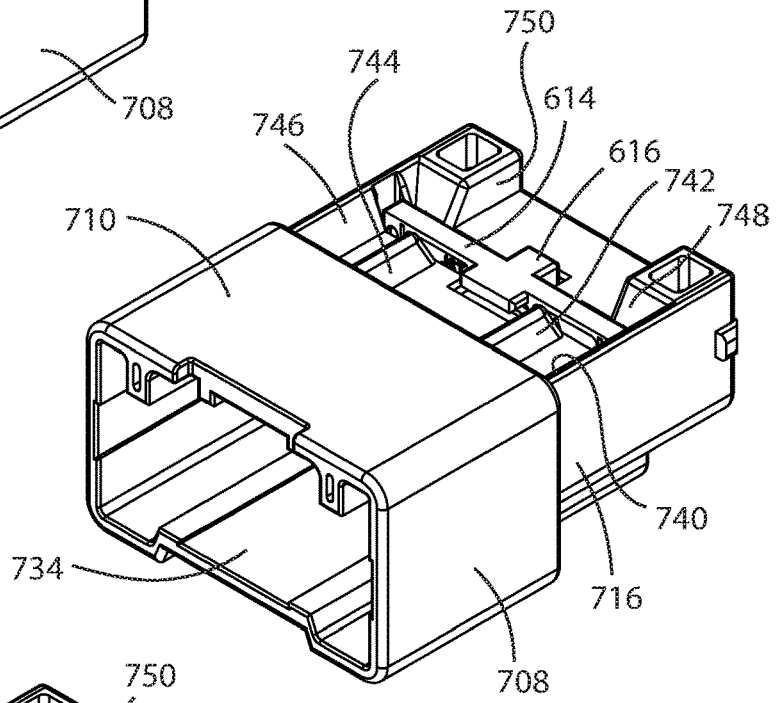
FIG. 15B is a perspective view of the male housing of the male connector assembly of FIG. 11 with a TPA member in the preset position.
Figure 15C:
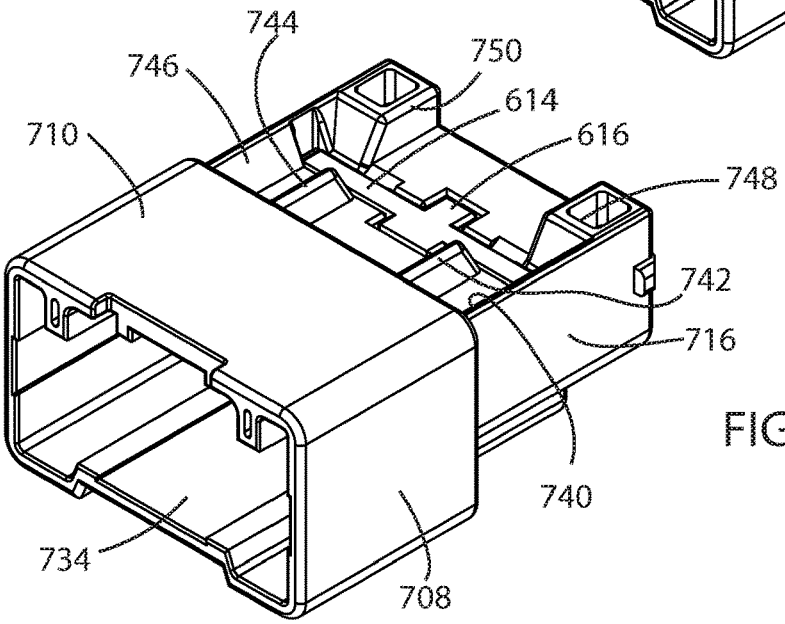
FIG. 15C is a perspective view of the male housing of the male connector assembly of FIG. 11 with a TPA member in the final lock position.

FIG. 15B is a perspective view of the male housing 700 of the male connector assembly of FIG. 11 with TPA member 800 in the preset position. FIG. 15C is a perspective view of the male housing 700 of the male connector assembly of FIG. 11 with TPA member 800 in the final lock position.

FIG. 16 is a partial cross-sectional view, taken along line 16-16 in FIG. 14B, showing details of some features of the male housing 700 engaging with some features of TPA member 800, when TPA member 800 is in the preset position, in accordance with the principles of the present invention. FIG. 17 is an enlarged view of the portion denoted in FIG. 16.

For the preset position, the relationship between tab 438 and flexible features 602 and 604 is shown in FIGS. 16 and 17. FIGS. 16 and 17 show that the male housing 700 forms a groove 440 or receiving area 440 on a surface of the aperture 720 of the male housing 700. The groove 440 or receiving area 440 receives flexible feature 602 and not flexible feature 604 when a TPA member is in the preset position.

The female housing 400 forms aperture 428 to receive guide 616 of the TPA member 600, and also forms aperture 430 to receive guide 618 of the TPA member 600. The female housing 400 forms two tabs 438 on an interior of the female housing 400. The two tabs 438 are visible inside aperture 420, as shown in FIG. 6A.

The male housing 700 forms aperture 720 for receiving the bottom 612 of the TPA member 800, also known as the insertion side 612 of the TPA member 800. The male housing 700 forms two tabs 438 on an interior of the male housing 700. The two tabs 438 are visible inside aperture 720, as shown in FIG. 14A.

When TPA member 600 is not in aperture 420 of female housing 400, tabs 438 are visible, as shown in FIG. 6A. However, when TPA member 600 is in the preset position, as shown in FIG. 6B, the tabs 438 are not visible. When TPA member 600 is in the preset position, as shown in FIG. 6B, the flexible features 604 and 608 of TPA member 600 are visible in aperture 420.

When TPA member 800 is not in aperture 720 of male housing 700, tabs 438 are visible, as shown in FIG. 14A. However, when TPA member 800 is in the preset position, as shown in FIG. 14B, the tabs 438 are not visible. When TPA member 800 is in the preset position, as shown in FIG. 14B, the flexible features 604 and 608 of TPA member 800 are visible in aperture 720.

FIG. 18 is a partial cross-sectional view, taken along line 18-18 in FIG. 14C, showing details of some features of the male housing 700 engaging with some features of the TPA member 800, when the TPA member 800 is in the final lock position, in accordance with the principles of the present invention. FIG. 19 is an enlarged view of the portion denoted in FIG. 18.

For the final lock position, the relationship between tab 438 and flexible features 602 and 604 is shown in FIGS. 18 and 19. FIGS. 18 and 19 show that the male housing 700 forms a groove 440 or receiving area 440, on a surface of the aperture 720 of the male housing 700. The groove 440 or receiving area 440 receives flexible feature 602 and flexible feature 604 when a TPA member is in the final lock position.

When TPA member 600 is in the final lock position, as shown in FIG. 6C, the tabs 438 are visible. When TPA member 800 is in the final lock position, as shown in FIG. 14C, the tabs 438 are visible.

Figure 20:
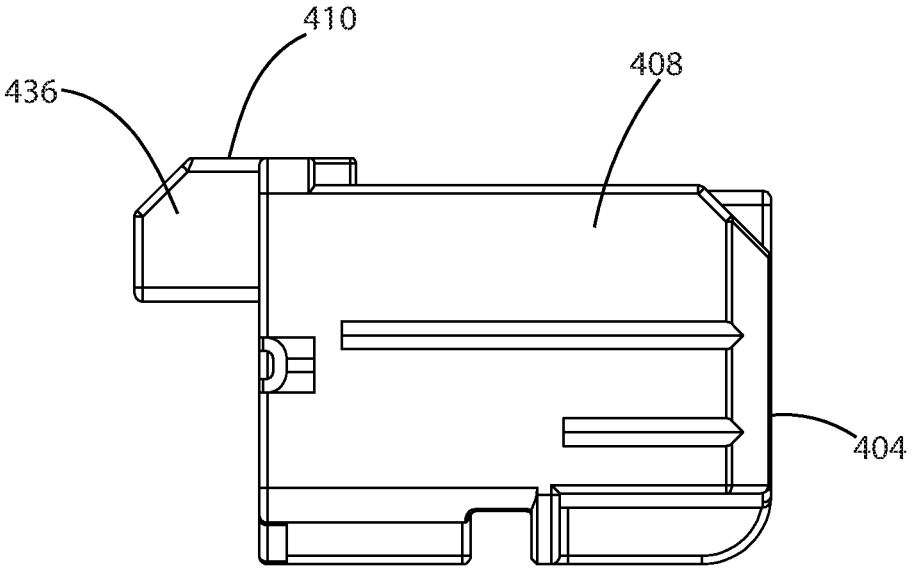
FIG. 20 is a side elevational view of the female housing of the connector apparatus of FIG. 3 without a TPA member and without a CPA member.
Figure 21:
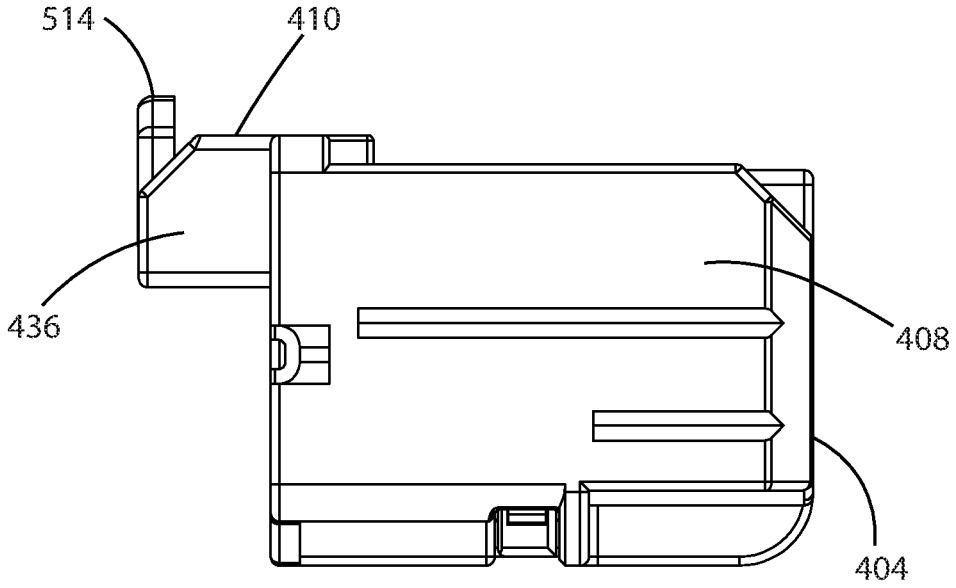
FIG. 21 is a side elevational view of the female housing of the connector apparatus of FIG. 3 with a TPA member in the preset position and a CPA member in the preset position.

FIG. 20 is a side elevational view of the female housing 400 of the connector apparatus 300 of FIG. 3 without a TPA member and without a CPA member. FIG. 21 is a side elevational view of the female housing 400 of the connector apparatus 300 of FIG. 3 with TPA member 600 in the preset position and CPA member 500 in the preset position.

Figure 22:
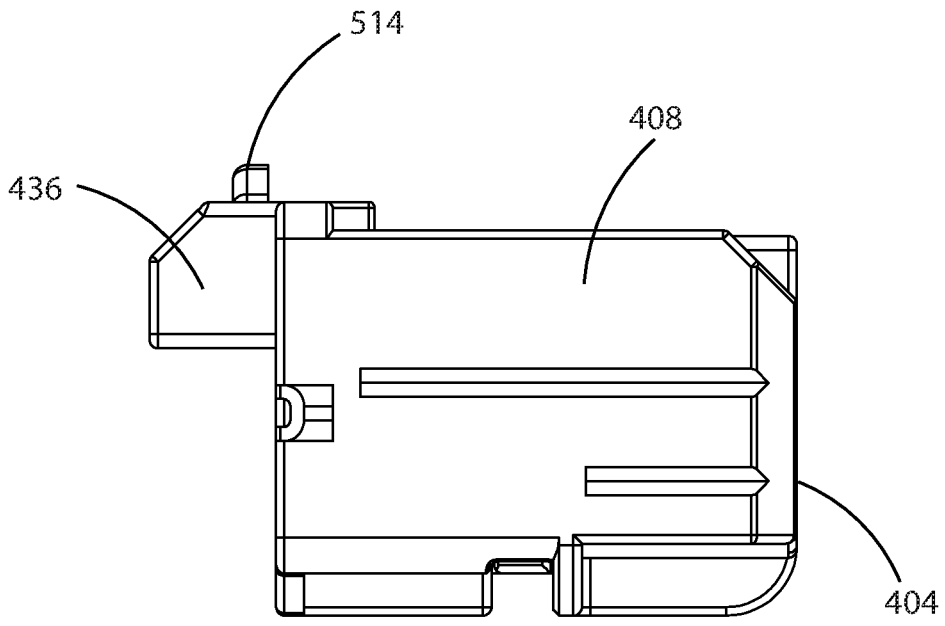
FIG. 22 is a side elevational view of the female housing of the connector apparatus of FIG. 3 with a TPA member in the final lock position and a CPA member in the final lock position.
Figure 23:
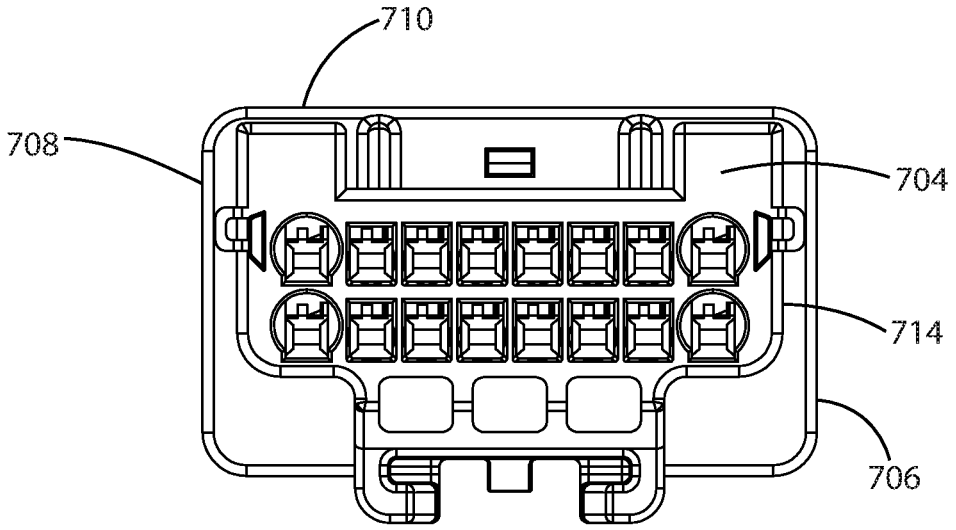
FIG. 23 is a rear end elevational view of the male housing of the male connector assembly of FIG. 11 without a TPA member.
Figure 24:
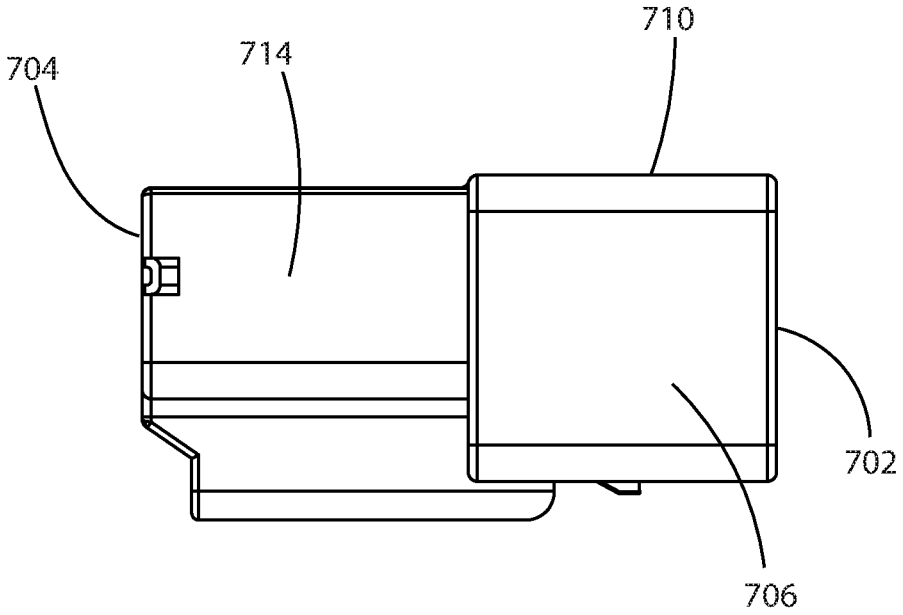
FIG. 24 is a side elevational view of the male housing of the male connector assembly of FIG. 11.
Figure 25:
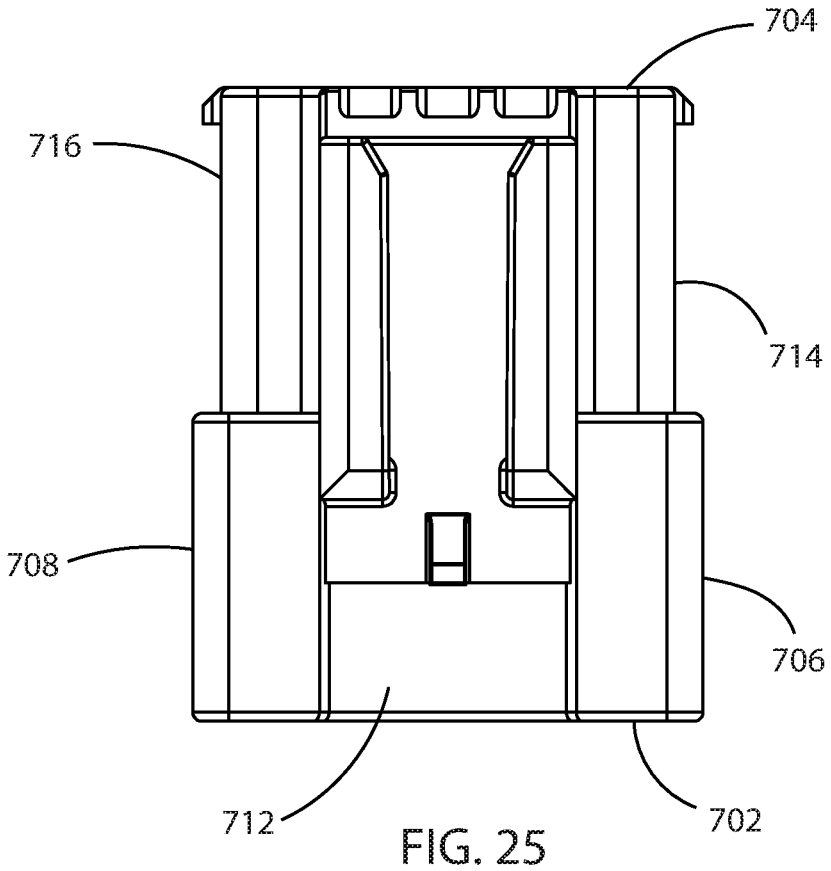
FIG. 25 is a bottom elevational view of the male housing of the male connector assembly of FIG. 11.

FIG. 22 is a side elevational view of the female housing 400 of the connector apparatus 300 of FIG. 3 with TPA member 600 in the final lock position and CPA member 500 in the final lock position. FIG. 23 is a rear end elevational view of the male housing 700 of the male connector assembly of FIG. 11 without a TPA member. FIG. 24 is a side elevational view of the male housing 700 of the male connector assembly of FIG. 11. FIG. 25 is a bottom elevational view of the male housing 700 of the male connector assembly of FIG. 11.

FIG. 26 is an exploded perspective view of a female connector assembly of a connector apparatus, in accordance with the principles of the present invention, showing a female housing 920, a TPA member 960 for the female housing 920, and a CPA member 500 for the female housing 920, in a six-pin configuration. TPA member 960 has insertion side (bottom) 962 and guide 966, as shown in FIG. 26.

Figure 27A:
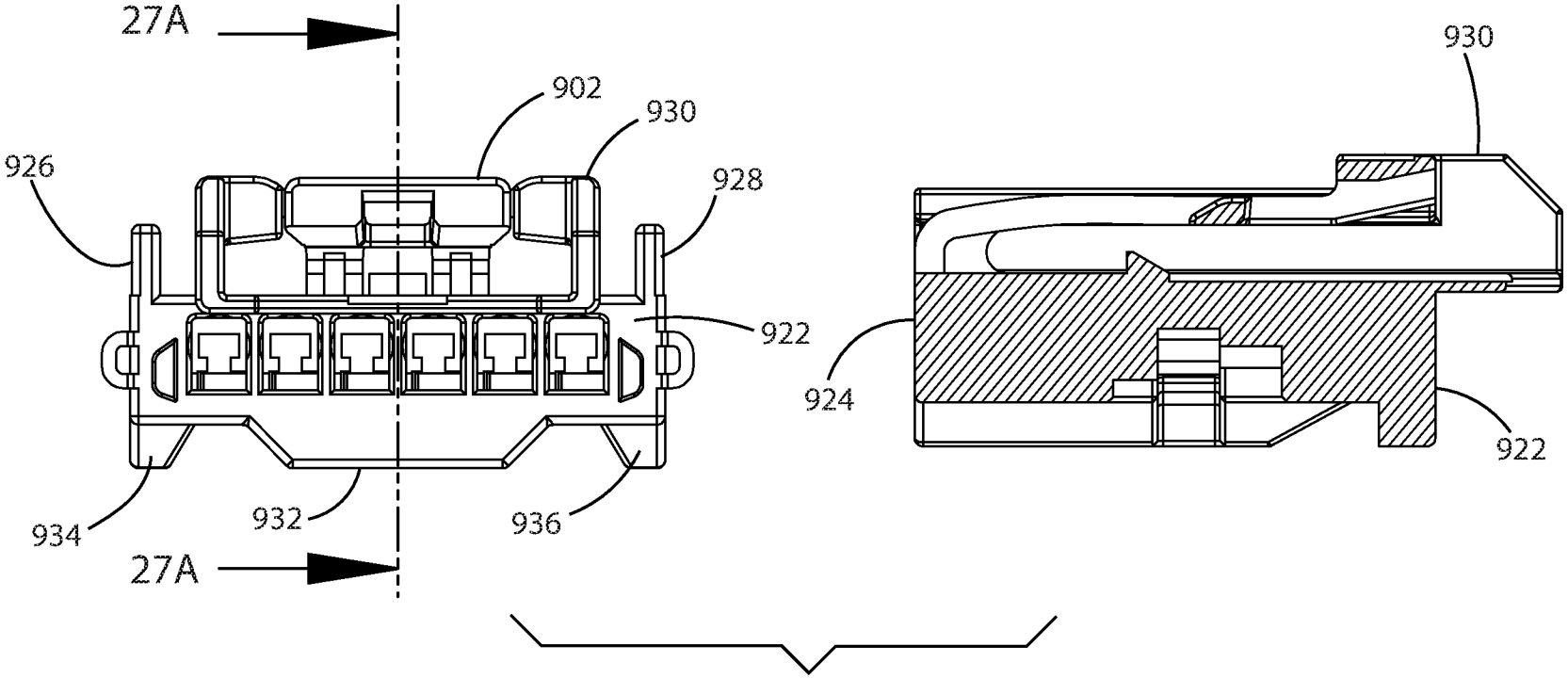
FIG. 27A includes a front end elevational view of the female housing of the female connector assembly of FIG. 26 without a TPA member and without a CPA member, and includes a cross-sectional view thereof, taken along line 27A-27A.

FIG. 27A includes an upper view and a lower view. The upper view is a front end elevational view of the female housing 920 of the female connector assembly of FIG. 26 without a TPA member and without a CPA member. The lower view is a cross-sectional view thereof, taken along line 27A-27A in the upper view.

FIG. 27A shows TPA protection ribs 934 and 936 on female housing 920. FIG. 27A also shows the following aspects of the female housing 920: front end 922; rear end 924; first side 926; second side 928; top 930; and bottom 932.

Figure 27B:
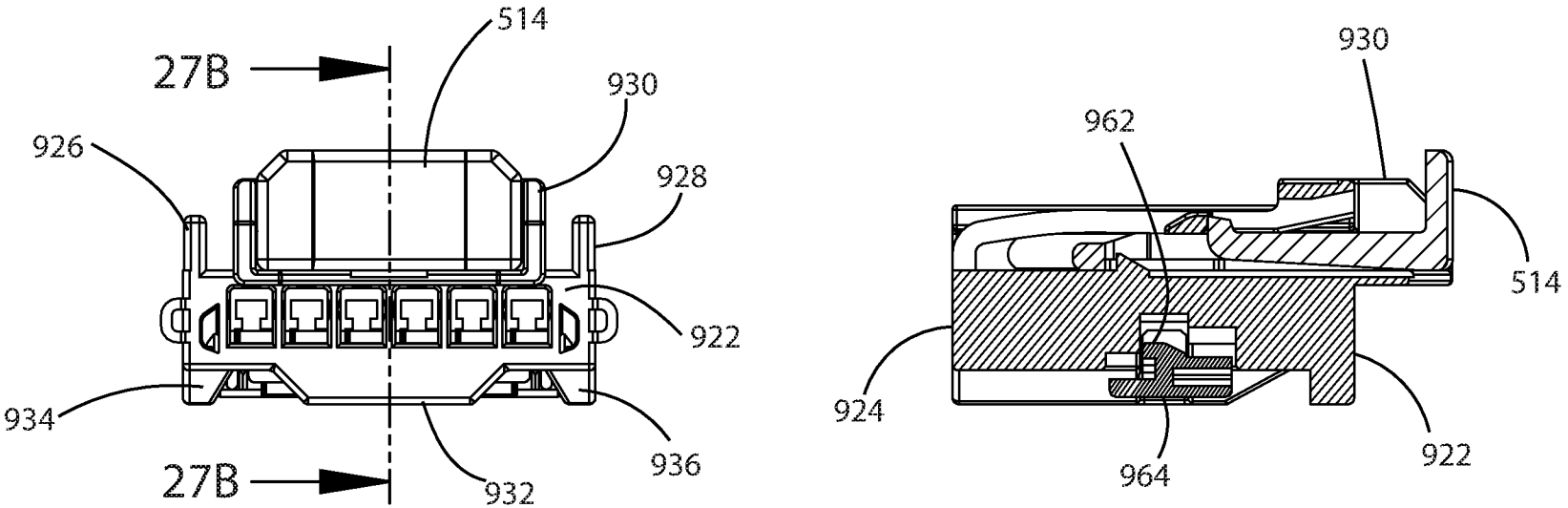
FIG. 27B includes a front end elevational view of the female housing of the female connector assembly of FIG. 26 with a TPA member in the preset position and a CPA member in the preset position, and includes a cross-sectional view thereof, taken along line 27B-27B.

FIG. 27B includes an upper view and a lower view. The upper view is a front end elevational view of the female housing 920 of the female connector assembly of FIG. 26 with a TPA member 960 in the preset position and a CPA member 500 in the preset position. The lower view is a cross-sectional view thereof, taken along line 27B-27B in the upper view. FIG. 27B shows the position of insertion side (bottom) 962 and exposed side (top) 964 of TPA member 960, when TPA member 960 is in the preset position.

Figure 27C:
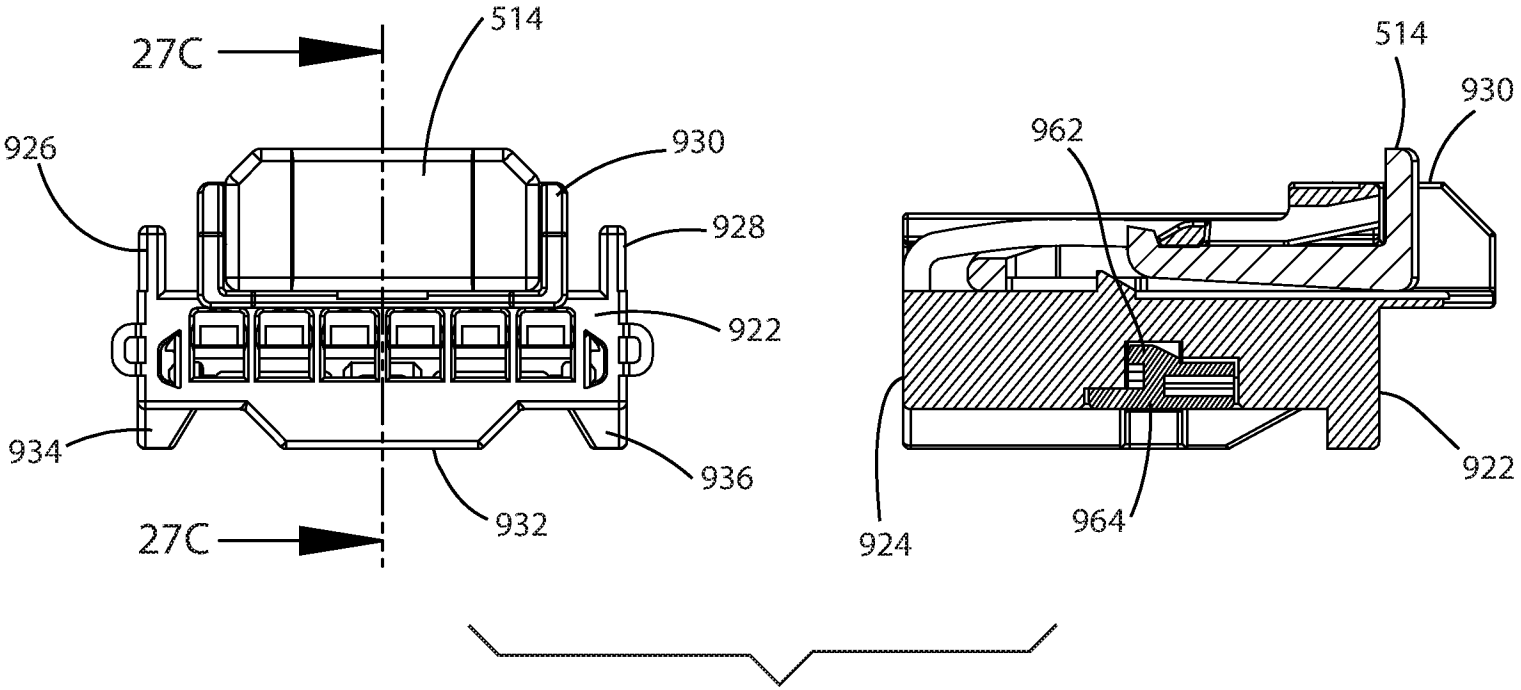
FIG. 27C includes a front end elevational view of the female housing of the female connector assembly of FIG. 26 with a TPA member in the final lock position and a CPA member in the final lock position, and includes a cross-sectional view thereof, taken along line 27C-27C.

FIG. 27C includes an upper view and a lower view. The upper view is a front end elevational view of the female housing of the female connector assembly of FIG. 26 with a TPA member in the final lock position and a CPA member in the final lock position. The lower view is a cross-sectional view thereof, taken along line 27C-27C in the upper view. FIG. 27C shows the position of insertion side (bottom) 962 and exposed side (top) of TPA member 960, when TPA member 960 is in the final lock position.

Figure 28:
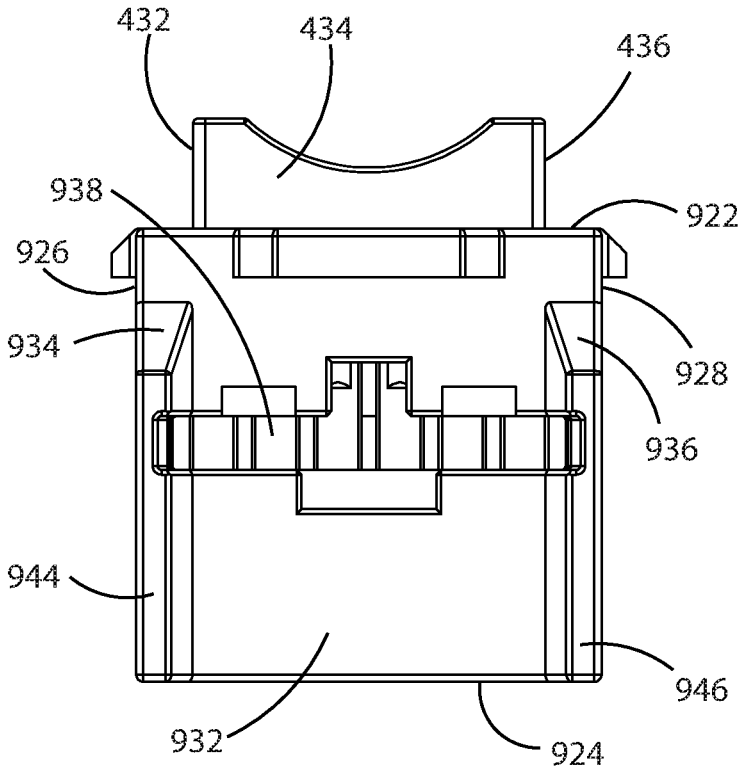
FIG. 28 is a bottom elevational view of the female housing of the female connector assembly of FIG. 26 without a TPA member and without a CPA member.
Figure 29:
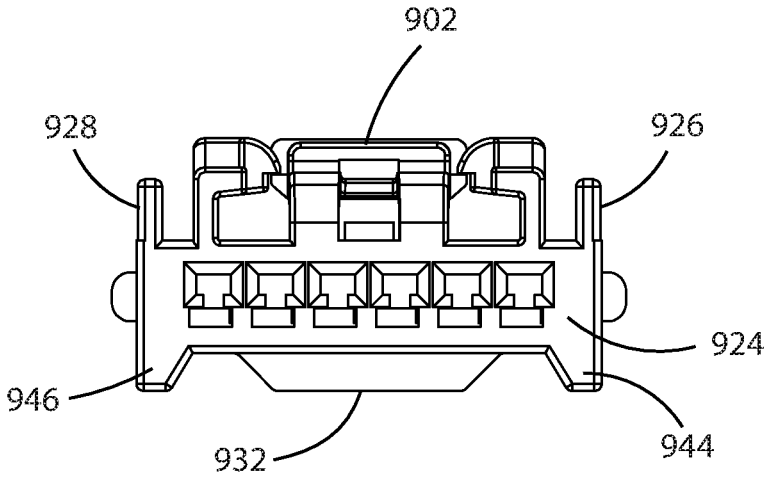
FIG. 29 is a rear end elevational view of the female housing of the female connector assembly of FIG. 26 without a TPA member and without a CPA member.

FIG. 28 is a bottom elevational view of the female housing 920 of the female connector assembly of FIG. 26 without a TPA member and without a CPA member. FIG. 28 shows that female housing 920 has TPA protection ribs 934, 936, 944, and 946. FIG. 28 shows CPA protection walls 432, 434, and 436. The female housing 920 forms aperture 938 for receiving the insertion side (bottom) 962 of TPA member 960. FIG. 29 is a rear end elevational view of the female housing 920 of the female connector assembly of FIG. 26 without a TPA member and without a CPA member.

Figure 30:
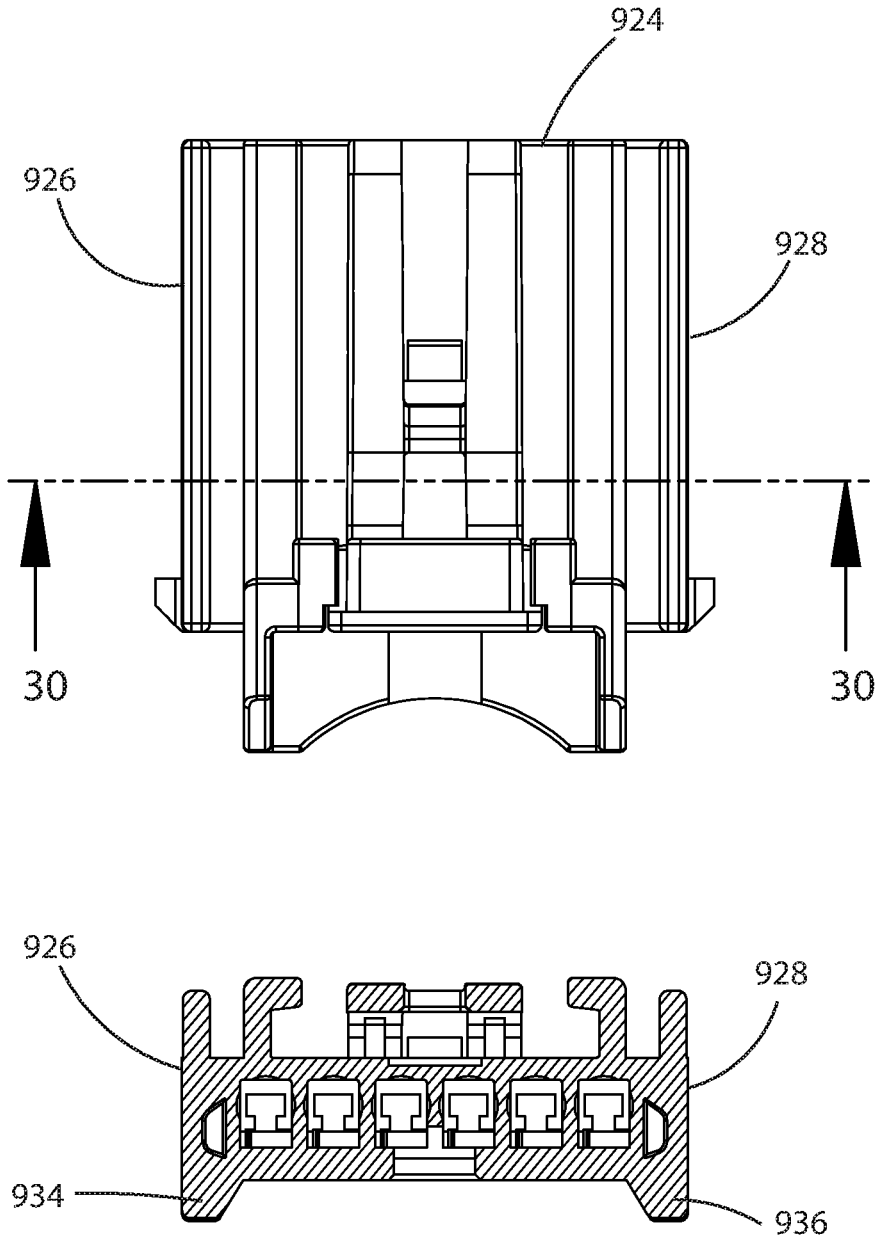
FIG. 30 includes a top elevational view of the female housing of the female connector assembly of FIG. 26 without a TPA member and without a CPA member, and includes a cross-sectional view thereof, taken along line 30-30.

FIG. 30 includes an upper view and a lower view. The upper view is a top elevational view of the female housing 920 of the female connector assembly of FIG. 26 without a TPA member and without a CPA member. The lower view is a cross-sectional view taken along line 30-30.

Figure 31:
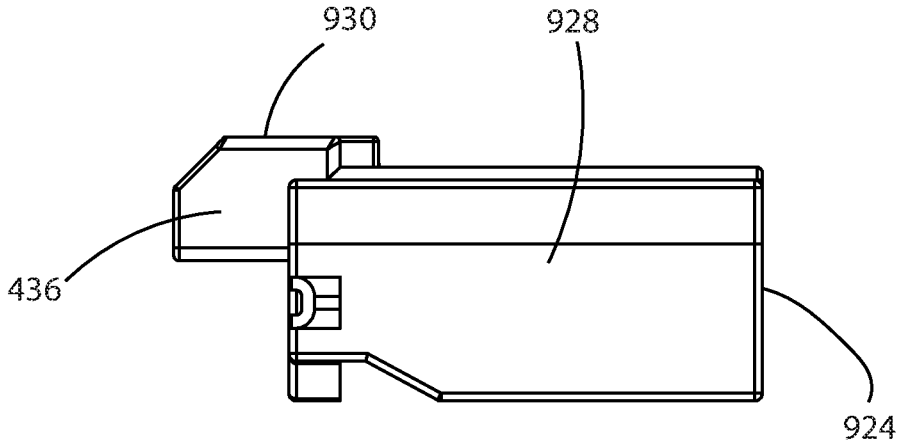
FIG. 31 is a side elevational view of the female housing of the female connector assembly of FIG. 26 without a TPA member and without a CPA member.
Figure 32:
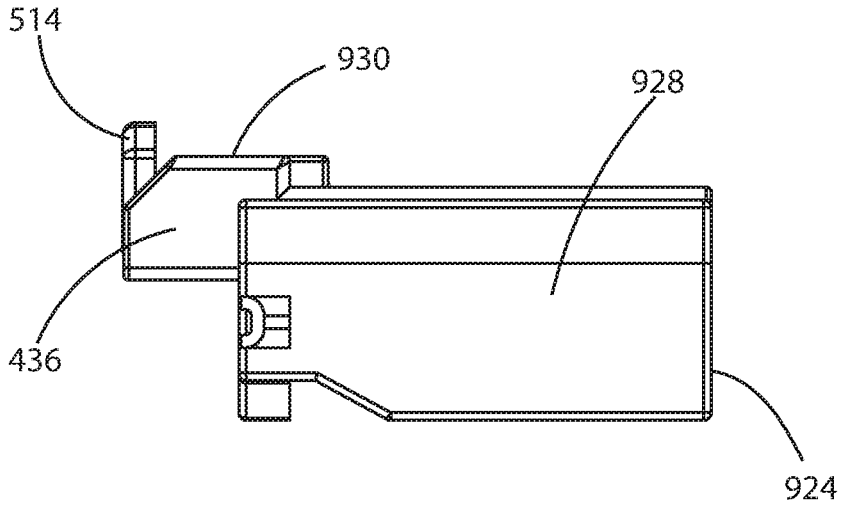
FIG. 32 is a side elevational view of the female housing of the female connector assembly of FIG. 26 with a TPA member in the preset position and a CPA member in the preset position.

FIG. 31 is a side elevational view of the female housing 920 of the female connector assembly of FIG. 26 without a TPA member and without a CPA member. FIG. 32 is a side elevational view of the female housing 920 of the female connector assembly of FIG. 26 with a TPA member 960 in the preset position and a CPA member 500 in the preset position.

Figure 33:
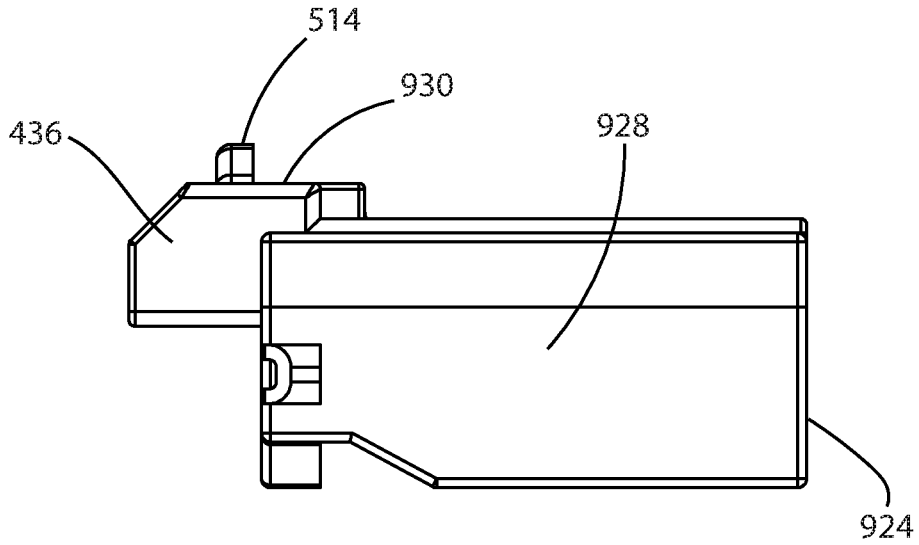
FIG. 33 is a side elevational view of the female housing of the female connector assembly of FIG. 26 with a TPA member in the final lock position and a CPA member in the final lock position.

FIG. 33 is a side elevational view of the female housing 920 of the female connector assembly of FIG. 26 with a TPA member 960 in the final lock position and a CPA member 500 in the final lock position.

FIG. 34 is an exploded perspective view of a male connector assembly, in accordance with the principles of the present invention, showing a male housing 970 and a TPA member 960 for the male housing 970, in a six-pin configuration.

FIG. 34 shows that TPA member 960 has an exposed (top) side 964, a guide 966, and a guide 968. FIG. 34 also shows that male housing 970 has TPA protection ribs 988, 990, 992, 994, 996, and 998. The male housing 970 has a rear end 974 and has a plurality of terminal apertures 985. Male housing 970 has six terminal apertures 985. Other configurations are possible.

A male housing 700 having 16 terminal apertures has been described herein, and a male housing 970 having 6 terminal apertures has been described herein, in accordance with the principles of the present invention. Male housings are not limited to those two configurations. Male housings can have other numbers of terminal apertures, in accordance with the principles of the present invention.

A female housing 400 having 16 terminal apertures has been described herein, and a female housing 920 having 6 terminal apertures has been described herein, in accordance with the principles of the present invention. Female housings are not limited to those two configurations. Female housings can have other numbers of terminal apertures, in accordance with the principles of the present invention.

Figure 35:
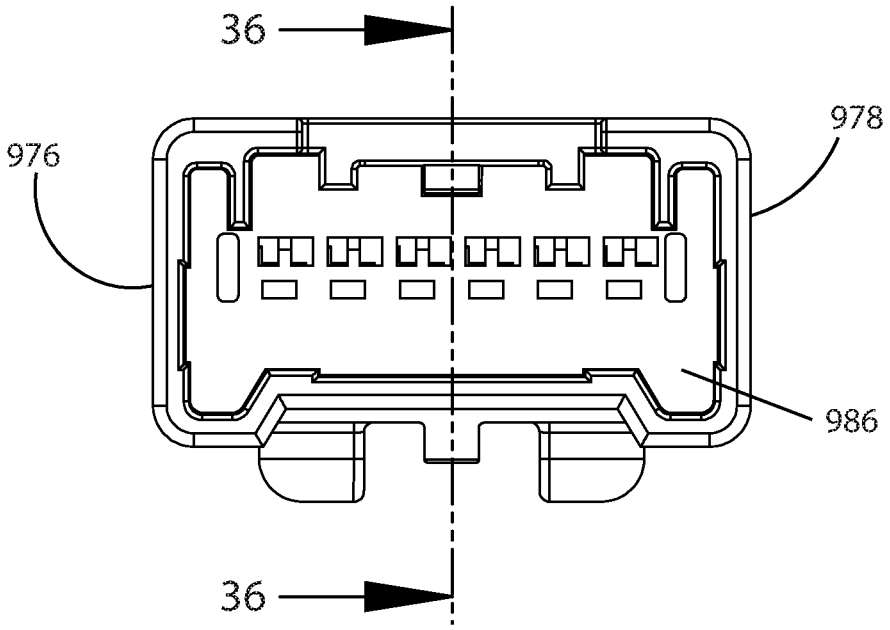
FIG. 35 is a front end elevational view of the male housing of the male connector assembly of FIG. 34.

FIG. 35 is a front end elevational view of the male housing 970 of the male connector assembly of FIG. 34. Male housing 970 has a first side 976 and a second side 978, and has an aperture 986 for receiving a rear end 924 of female housing 920.

Figure 36:
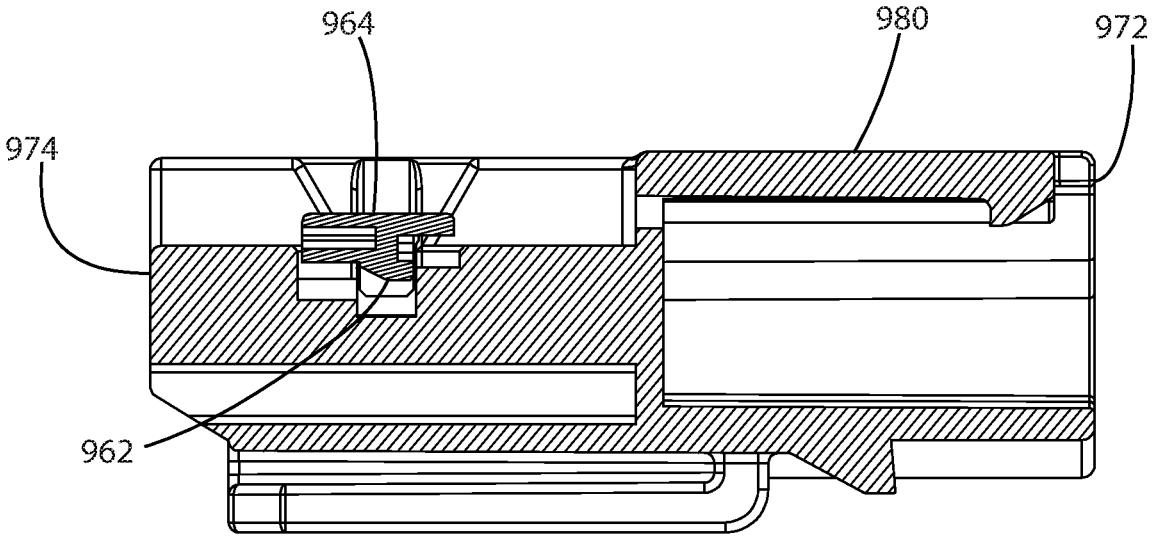
FIG. 36 is a cross-sectional view, taken along line 36-36 in FIG. 35, when a TPA member is in a preset position.

FIG. 36 is a cross-sectional view, taken along line 36-36 in FIG. 35, when a TPA member 960 is in a preset position. The male housing 970 has a top 980, a front end 972, and a rear end 974. The positions of the insertion side (bottom) 962 and the exposed side (top) 964 are depicted in FIG. 36, when the TPA member 960 is in the preset position.

Figure 37:
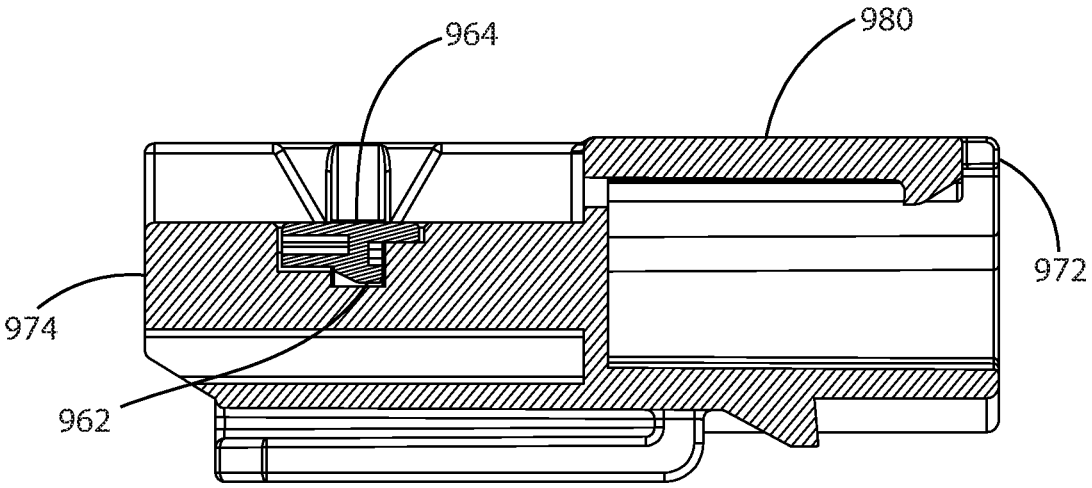
FIG. 37 is a cross-sectional view, taken along line 36-36 in FIG. 35, when a TPA member is in a final lock position.

FIG. 37 is a cross-sectional view, taken along line 36-36 in FIG. 35, when a TPA member 960 is in a final lock position. The positions of the insertion side (bottom) 962 and the exposed side (top) 964 are depicted in FIG. 36, when the TPA member 960 is in the final lock position.

Figure 38:
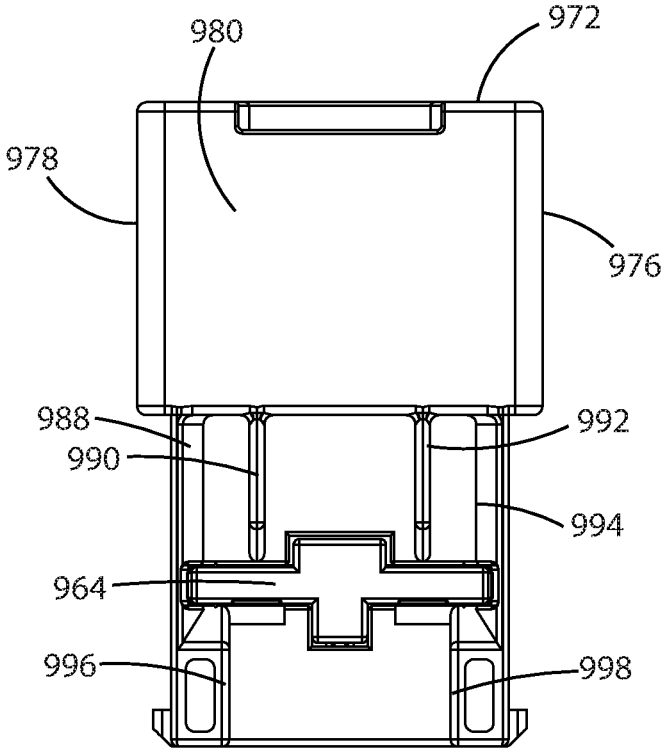
FIG. 38 is a top elevational view of the male housing of the male connector assembly of FIG. 34 with a TPA member in the preset position.
Figure 39:
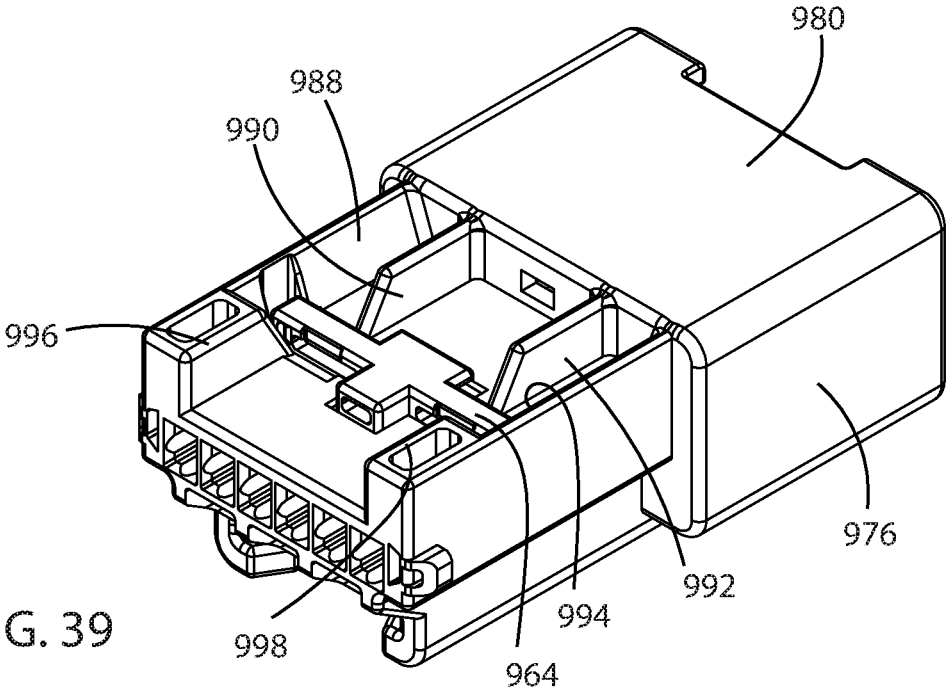
FIG. 39 is a perspective view of the male housing of the male connector assembly of FIG. 34 with a TPA member in the preset position.

FIG. 38 is a top elevational view of the male housing 970 of the male connector assembly of FIG. 34 with a TPA member 960 in the preset position. FIG. 39 is a perspective view of the male housing 970 of the male connector assembly of FIG. 34 with a TPA member 960 in the preset position.

FIG. 34 depicts an aperture for receiving the insertion side (bottom) 962 of TPA member 960, and FIG. 39 shows TPA member 960 in that aperture for receiving the insertion side (bottom) 962 of TPA member 960 with the TPA member 960 in the preset position.

Figure 40:
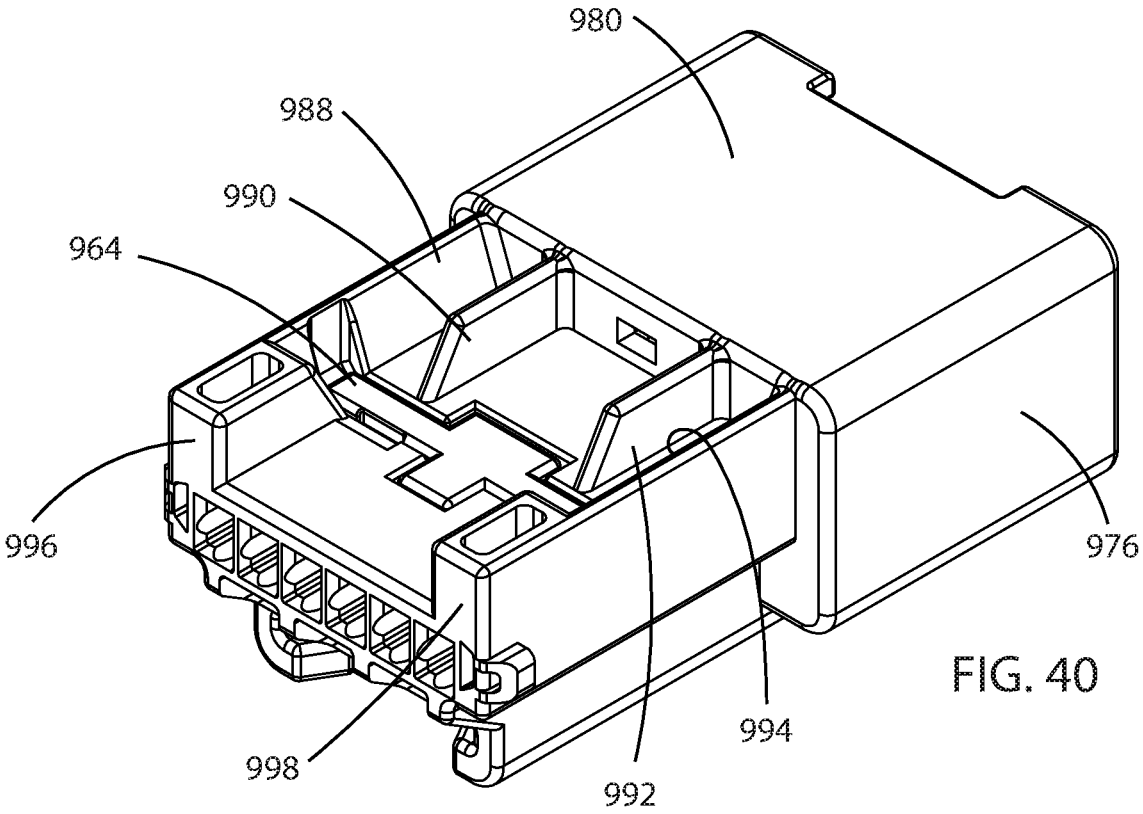
FIG. 40 is a perspective view of the male housing of the male connector assembly of FIG. 34 with a TPA member in the final lock position.

FIG. 40 is a perspective view of the male housing 970 of the male connector assembly of FIG. 34 with a TPA member 960 in the final lock position. FIG. 34 depicts an aperture for receiving the insertion side (bottom) 962 of TPA member 960, and FIG. 40 shows TPA member 960 in that aperture for receiving the insertion side (bottom) 962 of TPA member 960 with the TPA member 960 in the final lock position.

Figure 41:
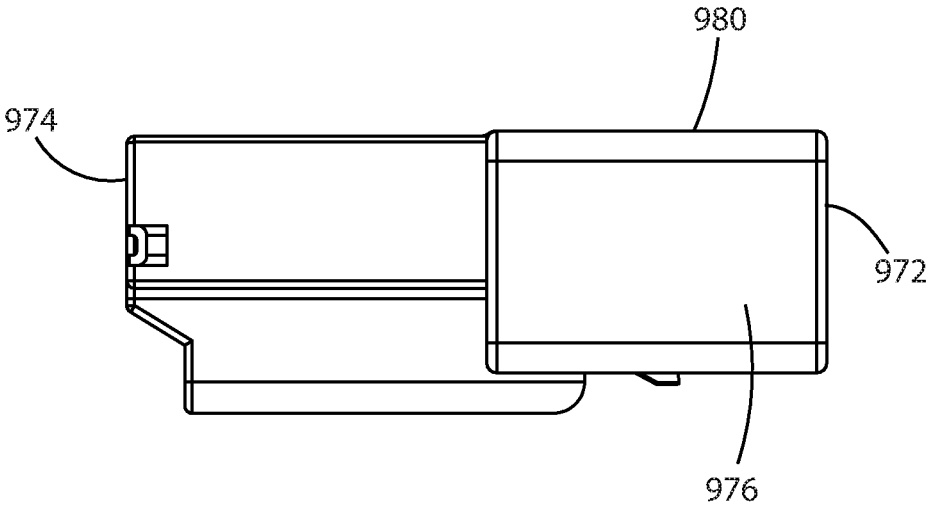
FIG. 41 is a side elevational view of the male housing of the male connector assembly of FIG. 34.
Figure 42:
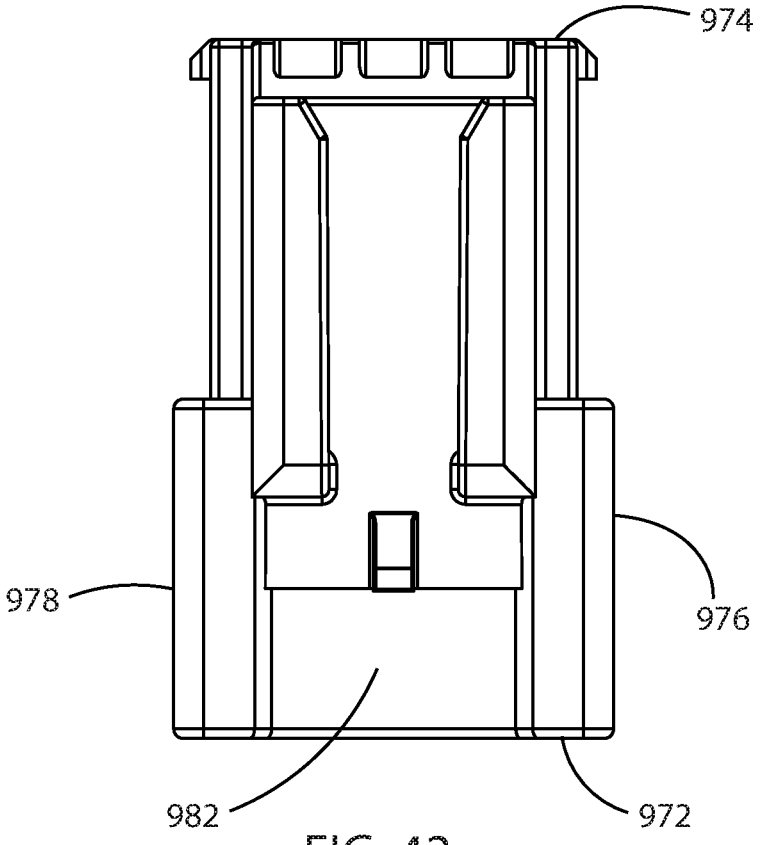
FIG. 42 is a bottom elevational view of the male housing of the male connector assembly of FIG. 34.

FIG. 41 is a side elevational view of the male housing 970 of the male connector assembly of FIG. 34. FIG. 42 is a bottom elevational view of the male housing 970 of the male connector assembly of FIG. 34. FIG. 42 depicts the bottom 982 of the male housing 970.

The female housing 920 is mated with the male housing 970 when the rear end 924 of the female housing 920 is received into the aperture 986 of the male housing 970. The female housing 400 is mated with the male housing 700 when the rear end 404 of the female housing 400 is received into the aperture 734 of the male housing 700.

As confirmed by the upper view and lower view of FIG. 4B, for the preset position, the exposed side (top) 614 of TPA member 600 does not extend away from the female housing 400 beyond the TPA protection ribs 416 and 418. The TPA protection ribs 416 and 418 protect the TPA member 600 in the preset position, because the TPA protection ribs 416 and 418 extend away from the female housing 400 beyond the exposed side (top) 614 of TPA member 600.

The fact that the TPA protection ribs extend away from a female housing beyond the exposed side (top) of a TPA member, in the preset position, is also shown in the lower view of FIG. 5B, for example.

FIG. 7B shows that an outermost edge of TPA protection ribs 446 and 448 of female housing 400 extend further away from the female housing 400 than the exposed side (top) 614, in the preset position, and thus the TPA member 600 is protected by the ribs 446 and 448. That is, as shown in FIG. 7B, an outermost edge of TPA protection ribs 446 and 448 of female housing 400 is lower than the exposed side (top) 614, in the preset position, and thus the TPA member 600 is protected by the ribs 446 and 448. The bottom 412 of female housing 400 also extends below the exposed side (top) 614, as shown in FIG. 7B, and thus the bottom 412 also helps to prevent the TPA member 600 from inadvertently being moved from the preset position to the final lock position during shipping and/or handling.

As depicted by FIG. 13B, for the preset position, the exposed side (top) 614 of the TPA member does not extend away from the male housing 700 beyond the TPA protection ribs 740, 742, 744, 746, 748, and 750. The TPA protection ribs 740, 742, 744, 746, 748, and 750 protect the TPA member in the preset position, because the TPA protection ribs 740, 742, 744, 746, 748, and 750 extend away from the male housing 700 beyond the exposed side (top) 614 of the TPA member. See also FIG. 15B.

FIG. 13B shows that, for the preset position, the exposed side (top) 614 of TPA member is positioned nearer to the male housing 700 than the outermost edges of the TPA protection ribs 740, 742, 744, 746, 748, and 750. That is, the outermost edges of the TPA protection ribs 740, 742, 744, 746, 748, and 750 extend above the exposed side (top) 614 of TPA member, in the preset position. This is shown in FIGS. 13B, 15B, and 1, for example. Thus, the tops of the TPA protection ribs are above the top of the TPA member, when the TPA member is in the preset position, as shown in FIGS. 1, 13B, and 15B, for example, and the TPA protection ribs on the male housing help to prevent the TPA member from being bumped inadvertently or pushed inadvertently into the final lock position during shipping and/or handling, for example.

As shown in FIGS. 11, 15A, and 15B, for example, the TPA protection ribs 742, 744, 748, and 750 are shaped to slope down toward the aperture receiving the TPA member 600. The sloping surfaces help to guide the TPA member 600 into the aperture in male housing 700, for example, when a user is first inserting the TPA member 600 into the aperture of the male housing 700.

As shown in FIGS. 34 and 39, for example, the TPA protection ribs 990, 992, 996, and 998 are shaped to slope down toward the aperture receiving the TPA member 960. The sloping surfaces help to guide the TPA member 960 into the aperture in male housing 970, for example, when a user is first inserting the TPA member 960 into the aperture of the male housing 970.

Figure 43:
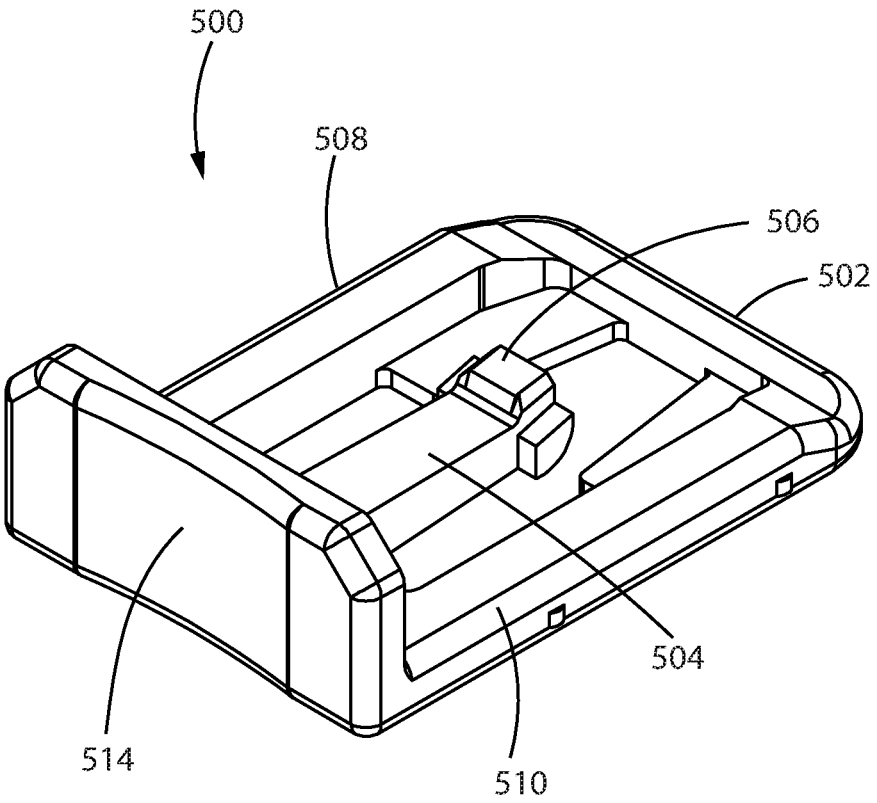
FIG. 43 is a perspective view of the CPA member of FIG. 3.

FIG. 43 is a perspective view of the CPA member 500 of FIG. 3. CPA member 500 has a rear upright portion 514, first side 508, second side 510, central beam 504, front tip 506 of central beam 504, and front edge 502. CPA member 500 also has a rear base 512, as shown in the upper view of FIG. 5B. A user can push rear upright portion 514 to push CPA member 500 to the preset position and to the final lock position.

Although the foregoing description is directed to the preferred embodiments of the invention, it is noted that other variations and modifications will be apparent to those skilled in the art, and may be made without departing from the spirit or scope of the invention. Moreover, features described in connection with one embodiment of the invention may be used in conjunction with other embodiments, even if not explicitly stated above.

LIST OF REFERENCE NUMERALS

100 Connector apparatus, six-pin configuration
102 Female housing
104 CPA member in female housing 102
108 Male housing
110 TPA member in male housing 108
200 Connector apparatus, six-pin configuration
202 Female housing
204 CPA member in female housing 202
208 Male housing
210 TPA member in male housing 208
300 Connector apparatus, sixteen-pin configuration
400 Female housing, sixteen-pin configuration
402 Front end of female housing 400
404 Rear end of female housing 400
406 First side of female housing 400
408 Second side of female housing 400
410 Top of female housing 400
412 Bottom of female housing 400
414 Terminal aperture on front end of female housing 400
416 TPA protection rib
418 TPA protection rib
420 Aperture for receiving insertion side (bottom) of TPA member
422 Protrusion (shark fin) on interior of female housing 400
424 Aperture for receiving front edge of CPA member
426 Terminal aperture on rear end of female housing 400
428 Aperture for receiving guide 616 of TPA member
430 Aperture for receiving guide 618 of TPA member
432 CPA protection wall
434 CPA protection wall
436 CPA protection wall
438 Tab
440 Receiving area in housing, receiving flexible features (protrusions) of TPA member
442 TPA protection rib
444 TPA protection rib
446 TPA protection rib
448 TPA protection rib
500 CPA member
502 Front edge of CPA member
504 Central beam of CPA member
506 Front tip of central beam of CPA member
508 First side of CPA member
510 Second side of CPA member
512 Rear base of CPA member
514 Rear upright portion of CPA member
600 TPA member, sixteen-pin configuration
602 Flexible feature (protrusion)
604 Flexible feature (protrusion)
606 Flexible feature (protrusion)
608 Flexible feature (protrusion)
610 Body of TPA member
612 Insertion side (bottom) of TPA member
614 Exposed side (top) of TPA member
616 Guide
618 Guide
620 Terminal aperture on TPA member
700 Male housing, sixteen-pin configuration
702 Front end of male housing 700
704 Rear end of male housing 700
706 First side of male housing 700
708 Second side of male housing 700
710 Top of male housing 700
712 Bottom of male housing 700
714 Side of male housing 700
716 Side of male housing 700
720 Aperture for receiving insertion side (bottom) of TPA member
726 Terminal aperture on rear end of male housing 700
728 Aperture for receiving guide 616 of TPA member
730 Aperture for receiving guide 618 of TPA member
732 Protrusion (shark fin) on male housing 700
734 Aperture for receiving rear end of female housing 400
740 TPA protection rib
742 TPA protection rib
744 TPA protection rib
746 TPA protection rib
748 TPA protection rib
750 TPA protection rib
800 TPA member, sixteen-pin configuration
902 Button of connector latch
904 First latch beam of connector latch
906 Second latch beam of connector latch
908 Latch surface of connector latch
920 Female housing, six-pin configuration
922 Front end of female housing 920
924 Rear end of female housing 920
926 First side of female housing 920
928 Second side of female housing 920
930 Top of female housing 920
932 Bottom of female housing 920
934 TPA protection rib
936 TPA protection rib
938 Aperture for receiving insertion side (bottom) of TPA member 960
944 TPA protection rib
946 TPA protection rib
960 TPA member, six-pin configuration
962 Insertion side (bottom) of TPA member 960
964 Exposed side (top) of TPA member 960
966 Guide
968 Guide
970 Male housing, six-pin configuration
972 Front end of male housing 970
974 Rear end of male housing 970
976 First side of male housing 970
978 Second side of male housing 970
980 Top of male housing 970
982 Bottom of male housing 970
985 Terminal aperture
986 Aperture for receiving rear end of female housing 920
988 TPA protection rib
990 TPA protection rib
992 TPA protection rib
994 TPA protection rib
996 TPA protection rib
998 TPA protection rib

We claim:

1. A male connector assembly, comprising:

a male housing forming at least a first aperture; a second aperture, and a third aperture;

a terminal position assurance member being received in the first aperture, wherein the terminal position assurance member forms a first guide and a second guide, the first guide extends a first distance from a first side of a planar surface of the terminal position assurance member, the second guide extends a second distance from a second side of the planar surface of the terminal position assurance member, the first side being opposite to the second side, the first and second distances being not equal; and at least one terminal position assurance protection rib extending outward from the male housing, wherein the at least one terminal position assurance protection rib includes at least a first pair of ribs, a second pair of ribs, and a third pair of ribs, the first pair of ribs extends in a first direction, the second pair of ribs extends in a second direction substantially perpendicular to the first direction, the third pair of ribs extends in the first direction, the first pair of ribs is spaced apart from the second pair of ribs, at least one rib of the second pair of ribs is in contact with at least one rib of the third pair of ribs, a first surface of the male housing forms the first aperture, the second aperture, and the third aperture, the first pair of ribs is formed on the first surface and protrudes upward away from the first surface, the second pair of ribs is formed on the first surface and protrudes upward away from the first surface, the third pair of ribs is formed on the first surface and protrudes upward away from the first surface, the first guide extending from an exposed side of the final position assurance member toward an insertion side of the terminal position assurance member without arriving at the insertion side, the second guide extending from the exposed side of the terminal position assurance member toward the insertion side of the terminal position assurance member without arriving at the insertion side, the first aperture receives all of the terminal position assurance member when in a final lock position, and extends down into a body of the male housing a first depth, the second aperture receives the second guide and extends down into the bod of the male housing a second depth less than the first depth, and the third aperture receives the first guide and extends down into the body of the male housing a third depth less than the first depth, wherein the second and third depths are not equal.

2. The male connector assembly of claim 1, wherein at least a first selected rib is selected from among the first pair of ribs, the second pair of ribs, and the third pair of ribs, at least a second selected rib is selected from among the first pair of ribs, the second pair of ribs, and the third pair of ribs, such that the first selected rib is different from the second selected rib, and the terminal position assurance member is disposed between the first selected rib and the second selected rib when the terminal position assurance member is in a preset position.

3. A male connector assembly, comprising:

a male housing forming at least a first aperture;

a terminal position assurance member being received in the first aperture, the terminal position assurance member forming at least a first guide and a second guide; and at least one terminal position assurance protection rib extending outward from the male housing, wherein the at least one terminal position assurance protection rib includes at least a first pair of ribs, a second pair of ribs, and a third pair of ribs, the first pair of ribs extends in a first direction, the second pair of ribs extends in a second direction substantially perpendicular to the first direction, the third pair of ribs extends in the first direction, the first pair of ribs is spaced apart from the second pair of ribs, at least one rib of the second pair of ribs is in contact with at least one rib of the third pair of ribs, a first surface of the male housing forms the first aperture, the first pair of ribs is formed on the first surface and protrudes upward and away from the first surface, the second pair of ribs is formed on the first surface and protrudes upward and away from the first surface, the third pair of ribs is formed on the first surface and protrudes upward and away from the first surface, and the first aperture receives all of the terminal position assurance member when in a final lock position, wherein at least a first selected rib is selected from among the first pair of ribs, the second pair of ribs, and the third pair of ribs, at least a second selected rib is selected from among the first pair of ribs, the second pair of ribs, and the third pair of ribs, such that the first selected rib is different from the second selected rib, and the terminal position assurance member is disposed between the first selected rib and the second selected rib when the terminal position assurance member is in a preset position, the first surface of the male housing forms at least a second aperture for accommodating the second guide the first surface of the male housing forms at least a third aperture for accommodating the first guide, the first guide extends from an exposed side of the terminal position assurance member toward an insertion side of the terminal position assurance member without arriving at the insertion side, the second guide extends from the exposed side of the terminal position assurance member toward the insertion side of the terminal position assurance member without arriving at the insertion side the first aperture extends down into a body of the e housing a first depth, the second aperture receives the second guide and extends down into the body of the male housing a second depth less than the first depth, the third aperture receives the first guide and extends down into the body of the male housing a third depth less than the first depth, wherein the second and third depths are not equal and wherein the at least one terminal position assurance protection rib extends further away from the male housing than the exposed side, when the terminal position assurance member is in the preset position.

* * * * *